US009171532B2

(12) United States Patent
Maezawa

(10) Patent No.: US 9,171,532 B2
(45) **Date of Patent: *Oct. 27, 2015**

(54) SOUND SIGNAL ANALYSIS APPARATUS, SOUND SIGNAL ANALYSIS METHOD AND SOUND SIGNAL ANALYSIS PROGRAM

(71) Applicant: YAMAHA CORPORATION, Hamamatsu-shi, Shizuoka-ken (JP)

(72) Inventor: Akira Maezawa, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/212,022

(22) Filed: Mar. 14, 2014

(65) Prior Publication Data

US 2014/0260912 A1 Sep. 18, 2014

(30) Foreign Application Priority Data

Mar. 14, 2013 (JP) ..... 2013-51158

(51) Int. Cl.
*G10H 7/00* (2006.01)
*G10H 1/40* (2006.01)

(52) U.S. Cl.
CPC . *G10H 1/40* (2013.01); *G10H 7/00* (2013.01); *G10H 2210/031* (2013.01); *G10H 2210/061* (2013.01); *G10H 2210/076* (2013.01); *G10H 2210/385* (2013.01); *G10H 2220/081* (2013.01)

(58) Field of Classification Search
USPC ..... 84/612, 636, 652, 668
IPC ..... G10H 2210/061,2210/076, 2220/081
See application file for complete search history.

(56) References Cited

U.S. PATENT DOCUMENTS 5,491,751 A 2/1996 Paulson et al.
5,585,585 A 12/1996 Paulson et al.
(Continued)

FOREIGN PATENT DOCUMENTS

EP 1835503 A2 9/2007
JP 2009265493 A 11/2009

OTHER PUBLICATIONS

Degara et al., "Reliability-Informed Beat Tracking of Musical Signals", IEEE Transactions on Audio, Speech and Language Processing, vol. 20, No. 1, Jan. 1, 2012, pp. 290-301.
(Continued)

*Primary Examiner* — David Warren
(74) *Attorney, Agent, or Firm* — Rossi, Kimms & McDowell LLP

(57) ABSTRACT

A sound signal analysis apparatus 10 includes sound signal input portion for inputting a sound signal indicative of a musical piece; feature value calculation portion for calculating a first feature value indicative of a feature relating to existence of a beat in one of sections of the musical piece and a second feature value indicative of a feature relating to tempo in one of the sections of the musical piece; and estimation portion for concurrently estimating a beat position and a change in tempo in the musical piece by selecting, from among a plurality of probability models described as sequences of states q classified according to a combination of a physical quantity relating to existence of a beat in one of the sections of the musical piece and a physical quantity relating to tempo in one of the sections of the musical piece, a probability model whose sequence of observation likelihoods each indicative of a probability of concurrent observation of the first feature value and the second feature value in corresponding one of the sections of the musical piece satisfies a certain criterion.

11 Claims, 18 Drawing Sheets

(56) References Cited

U.S. PATENT DOCUMENTS

| | | | | |
|---|---|---|---|---|
| 5,808,219 | A * | 9/1998 | Usa | 84/600 |
| 7,449,627 | B2 | 11/2008 | Sako et al. | |
| 7,659,472 | B2 * | 2/2010 | Arimoto | 84/600 |
| 7,668,610 | B1 * | 2/2010 | Bennett | 700/94 |
| 7,711,652 | B2 * | 5/2010 | Schmelzer | 705/67 |
| 7,777,121 | B2 * | 8/2010 | Asano | 84/600 |
| 7,797,249 | B2 * | 9/2010 | Schmelzer et al. | 705/67 |
| 7,863,512 | B2 * | 1/2011 | Takeda | 84/612 |
| 7,952,013 | B2 | 5/2011 | Komori et al. | |
| 8,005,666 | B2 * | 8/2011 | Goto et al. | 704/207 |
| 8,153,880 | B2 | 4/2012 | Sasaki | |
| 8,178,770 | B2 * | 5/2012 | Kobayashi | 84/613 |
| 8,420,921 | B2 * | 4/2013 | Kobayashi | 84/613 |
| 8,437,869 | B1 * | 5/2013 | Bennett | 700/94 |
| 8,481,839 | B2 | 7/2013 | Shaffer et al. | |
| 8,484,691 | B2 * | 7/2013 | Schmelzer | 725/116 |
| 8,487,176 | B1 * | 7/2013 | Wieder | 84/615 |
| 8,595,009 | B2 * | 11/2013 | Lu et al. | 704/253 |
| 8,618,401 | B2 * | 12/2013 | Kobayashi | 84/609 |
| 8,645,279 | B2 * | 2/2014 | Schmelzer | 705/67 |
| 8,706,274 | B2 * | 4/2014 | Kobayashi | 700/94 |
| 8,829,322 | B2 * | 9/2014 | Walmsley | 84/611 |
| 8,873,813 | B2 * | 10/2014 | Tadayon et al. | 382/118 |
| 8,886,345 | B1 | 11/2014 | Izo et al. | |
| 2005/0081700 | A1 | 4/2005 | Kikumoto | |
| 2007/0157798 | A1 | 7/2007 | Sako et al. | |
| 2007/0169614 | A1 | 7/2007 | Sasaki et al. | |
| 2007/0221046 | A1 | 9/2007 | Ozaki et al. | |
| 2008/0053295 | A1 * | 3/2008 | Goto et al. | 84/616 |
| 2008/0097754 | A1 * | 4/2008 | Goto et al. | 704/214 |
| 2008/0202321 | A1 * | 8/2008 | Goto et al. | 84/616 |
| 2008/0245214 | A1 | 10/2008 | Kikumoto | |
| 2009/0025538 | A1 * | 1/2009 | Arimoto | 84/605 |
| 2009/0071315 | A1 * | 3/2009 | Fortuna | 84/609 |
| 2009/0163276 | A1 | 6/2009 | Inubushi et al. | |
| 2009/0288546 | A1 * | 11/2009 | Takeda | 84/612 |
| 2010/0011939 | A1 | 1/2010 | Nakadai et al. | |
| 2010/0077306 | A1 | 3/2010 | Shaffer et al. | |
| 2010/0126332 | A1 * | 5/2010 | Kobayashi | 84/613 |
| 2010/0170382 | A1 * | 7/2010 | Kobayashi | 84/613 |
| 2010/0186576 | A1 * | 7/2010 | Kobayashi | 84/612 |
| 2010/0211200 | A1 * | 8/2010 | Kobayashi | 700/94 |
| 2010/0246842 | A1 * | 9/2010 | Kobayashi | 381/61 |
| 2010/0251877 | A1 | 10/2010 | Jochelson et al. | |
| 2011/0112994 | A1 * | 5/2011 | Goto et al. | 706/12 |
| 2012/0031257 | A1 * | 2/2012 | Saino | 84/622 |
| 2012/0125179 | A1 * | 5/2012 | Kobayashi | 84/611 |
| 2013/0046536 | A1 * | 2/2013 | Lu et al. | 704/233 |
| 2013/0103624 | A1 * | 4/2013 | Thieberger | 706/12 |
| 2013/0192445 | A1 * | 8/2013 | Sumi et al. | 84/609 |
| 2013/0305904 | A1 * | 11/2013 | Sumi | 84/609 |
| 2014/0079297 | A1 * | 3/2014 | Tadayon et al. | 382/118 |
| 2014/0111418 | A1 * | 4/2014 | Lee et al. | 345/156 |
| 2014/0116233 | A1 * | 5/2014 | Walmsley | 84/612 |
| 2014/0121797 | A1 | 5/2014 | Ales | |
| 2014/0140536 | A1 * | 5/2014 | Serletic et al. | 381/98 |
| 2014/0174279 | A1 * | 6/2014 | Wong et al. | 84/609 |
| 2014/0180673 | A1 * | 6/2014 | Neuhauser et al. | 704/9 |
| 2014/0180674 | A1 * | 6/2014 | Neuhauser et al. | 704/9 |
| 2014/0180675 | A1 * | 6/2014 | Neuhauser et al. | 704/9 |
| 2014/0238220 | A1 * | 8/2014 | Nakamura | 84/613 |
| 2014/0260911 | A1 * | 9/2014 | Maezawa | 84/612 |
| 2014/0260912 | A1 * | 9/2014 | Maezawa | 84/612 |
| 2014/0297012 | A1 * | 10/2014 | Kobayashi | 700/94 |
| 2014/0358265 | A1 * | 12/2014 | Wang et al. | 700/94 |
| 2014/0366710 | A1 * | 12/2014 | Eronen et al. | 84/609 |
| 2015/0013527 | A1 * | 1/2015 | Buskies et al. | 84/611 |
| 2015/0013528 | A1 * | 1/2015 | Buskies et al. | 84/611 |

OTHER PUBLICATIONS

Klapuri et al., "Analysis of the Meter of Acoustic Musical Signals", IEEE Transactions on Audio, Speech, and Language Processing, Jan. 1, 2006, pp. 342-355 (cited as pp. 1-14).

Fox et al., "Drum'N'Bayes: On-line Variational Inference for Beat Tracking and Rhythm Recognition", International Computer Music Conference Proceedings, 2007, 8 pages.

Stark et al., "Real-Time Beat-Sychronous Analysis of Muscial Audio", Proceedings of the 12th International Conference on Digital Audio Effects (DAFX-09), Como, Italy, Sep. 1-4, 2009. pp. 1-6.

Rodriguez-Serrano et al., "Amplitude Modulated Sinusoidal Modeling for Audio Onset Detection", 18th European Signal Processing Conference (EUSIPCO-2010), Aalborg, Denmark, Aug. 23-27, 2010, 5 pages.

European Search Report dated Jul. 28, 2014, issued in corresponding European Patent Application No. 14157744.

Masataka Goto; "An Audio-based Real-time Beat Tracking System for Music With or Without Drum-sounds"; Journal of New Music Research, 2001, vol. 30, No. 2, pp. 159-171.

Masataka Goto, et al.; "Songle: A Web Service for Active Music Listening Improved by User Contributions"; 12th International Society for Music Information Retrieval Conference, 2011, pp. 311-316.

Klapuri, Anssi P., et al.; "Analysis of the Meter of Acoustic Musical Signals"; IEEE Trans. Speech and Audio Proc. (in press), pp. 1-14, 2004.

Dixon, Simon, et al.; "Beat Tracking with Musical Knowledge".

European Search Report issued in European application No. EP14157746.0, dated Jul. 25, 2014. Cited in U.S. pending related U.S. Appl. No. 14/207,816.

Davies, et al.; "Beat Tracking With a Two State Model", Queen Mary, University of London, Centre for Digital Music, Mile End Road, London E1 4NS, UK. (2 selected pages) Cited in U.S. pending related U.S. Appl. No. 14/207,816.

Oliveira, et al.; "IBT: A Real-Time Tempo and Beat Tracking System", 2010 International Society for Music Information Retrieval. (3 selected pages) Cited in U.S. pending related U.S. Appl. No. 14/207,816.

* cited by examiner

FIG.13

| XO(t) | 10 | 2 | 0.5 | 5 | 1 | 0 | 3 | 4 | 2 |
|---|---|---|---|---|---|---|---|---|---|
| $Log(P(XO(t_i) \mid Z_{6,0}(t_i)))$ | −11.04 | −0.62 | −1.76 | −1.27 | −1.27 | −2.35 | −0.40 | −0.62 | −0.62 |
| $Log(P(XO(t_i) \mid Z_{6,1}(t_i)))$ | −22.11 | −1.27 | −0.45 | −5.83 | −0.62 | −0.40 | −2.35 | −3.87 | −1.27 |
| $Log(P(XO(t_i) \mid Z_{6,2}(t_i)))$ | −22.11 | −1.27 | −0.45 | −5.83 | −0.62 | −0.40 | −2.35 | −3.87 | −1.27 |
| $Log(P(XO(t_i) \mid Z_{6,3}(t_i)))$ | −17.99 | −0.62 | −0.45 | −3.87 | −0.40 | −0.62 | −1.27 | −2.35 | −0.62 |
| $Log(P(XO(t_i) \mid Z_{6,4}(t_i)))$ | −22.11 | −1.27 | −0.45 | −5.83 | −0.62 | −0.40 | −2.35 | −3.87 | −1.27 |
| $Log(P(XO(t_i) \mid Z_{6,5}(t_i)))$ | −22.11 | −1.27 | −0.45 | −5.83 | −0.62 | −0.40 | −2.35 | −3.87 | −1.27 |

FIG.14

| | | | | | | | | | | | | $TP_\gamma$ |
|---|---|---|---|---|---|---|---|---|---|---|---|---|
| $TP_2$ | $\delta_{2,1}$ | $\delta_{2,2}$ | $\delta_{2,3}$ | $\delta_{2,4}$ | $\delta_{2,5}$ | $\delta_{2,6}$ | $\delta_{2,7}$ | $\delta_{2,8}$ | $\delta_{2,9}$ | $\delta_{2,10}$ | $\delta_{2,11}$ | $\delta_{2,12}$ |
| $TP_3$ | $\delta_{3,1}$ | $\delta_{3,2}$ | $\delta_{3,3}$ | $\delta_{3,4}$ | $\delta_{3,5}$ | $\delta_{3,6}$ | $\delta_{3,7}$ | $\delta_{3,8}$ | $\delta_{3,9}$ | $\delta_{3,10}$ | $\delta_{3,11}$ | $\delta_{3,12}$ |
| $TP_4$ | $\delta_{4,1}$ | $\delta_{4,2}$ | $\delta_{4,3}$ | $\delta_{4,4}$ | $\delta_{4,5}$ | $\delta_{4,6}$ | $\delta_{4,7}$ | $\delta_{4,18}$ | $\delta_{4,9}$ | $\delta_{4,10}$ | $\delta_{4,11}$ | $\delta_{4,12}$ |
| $TP_5$ | $\delta_{5,1}$ | $\delta_{5,2}$ | $\delta_{5,3}$ | $\delta_{5,4}$ | $\delta_{5,5}$ | $\delta_{5,6}$ | $\delta_{5,7}$ | $\delta_{5,8}$ | $\delta_{5,9}$ | $\delta_{5,10}$ | $\delta_{5,11}$ | $\delta_{5,12}$ |
| $TP_6$ | $\delta_{6,1}$ | $\delta_{6,2}$ | $\delta_{6,3}$ | $\delta_{6,4}$ | $\delta_{6,5}$ | $\delta_{6,6}$ | $\delta_{6,7}$ | $\delta_{6,8}$ | $\delta_{6,9}$ | $\delta_{6,10}$ | $\delta_{6,11}$ | $\delta_{6,12}$ |

| | |
|---|---|
| $Log(P(XB(t_i) \mid Z_{2,n}(t_i)))$ | 4.14425 |
| $Log(P(XB(t_i) \mid Z_{3,n}(t_i)))$ | 4.66149 |
| $Log(P(XB(t_i) \mid Z_{4,n}(t_i)))$ | 7.83838 |
| $Log(P(XB(t_i) \mid Z_{5,n}(t_i)))$ | 2.79372 |
| $Log(P(XB(t_i) \mid Z_{6,n}(t_i)))$ | 2.09529 |

FIG.17

L

| state | $t_0$ | $t_1$ | $t_2$ | $t_3$ | $t_4$ | $t_5$ | $t_6$ | $t_7$ | $t_8$ | $t_9$ |
|---|---|---|---|---|---|---|---|---|---|---|
| $q_{3,0}$ | 0 | 0 | 0 | 0 | 0 | 1 | 0 | 1 | 0 | 0 |
| $q_{3,1}$ | 0 | 0 | 0 | 0 | 0 | 0 | 0 | 0 | 0 | 0 |
| $q_{3,2}$ | 1 | 0 | 0 | 0 | 0 | 0 | 0 | 0 | 0 | 0 |
| $q_{4,0}$ | 1 | 0 | 0 | 1 | 0 | 1 | 0 | 2 | 0 | 0 |
| $q_{4,1}$ | 0 | 0 | 0 | 0 | 0 | 0 | 0 | 0 | 0 | 0 |
| $q_{4,2}$ | 0 | 0 | 0 | 0 | 0 | 0 | 0 | 0 | 0 | 0 |
| $q_{4,3}$ | 1 | 0 | 0 | 0 | 0 | 0 | 0 | 0 | 0 | 0 |
| $q_{5,0}$ | 0 | 0 | 0 | 1 | 0 | 1 | 0 | 1 | 0 | 0 |
| $q_{5,1}$ | 0 | 0 | 0 | 0 | 0 | 0 | 0 | 0 | 0 | 0 |
| $q_{5,2}$ | 0 | 0 | 0 | 0 | 0 | 0 | 0 | 0 | 0 | 0 |
| $q_{5,3}$ | 0 | 0 | 0 | 0 | 0 | 0 | 0 | 0 | 0 | 0 |
| $q_{5,4}$ | 1 | 0 | 0 | 0 | 0 | 0 | 0 | 0 | 0 | 0 |

FIG.18

C

| state | initial condition CS | $t_0$ | $t_1$ | $t_2$ | $t_3$ | $t_4$ | $t_5$ | $t_6$ | $t_7$ | $t_8$ | $t_9$ |
|---|---|---|---|---|---|---|---|---|---|---|---|
| $q_{3,0}$ | 0 | 0 | 0 | 2 | 0.4 | −0.2 | 2.8 | 2.4 | 1.2 | 2.6 | 2.2 |
| $q_{3,1}$ | 0 | 0 | 2 | 0.4 | −0.2 | 1.8 | 2.4 | 0.2 | 2.6 | 2.2 | 4.2 |
| $q_{3,2}$ | 1 | 2 | 0.4 | −0.2 | 1.8 | 2.4 | 0.2 | 2.6 | 2.2 | 4.2 | 2.4 |
| $q_{4,0}$ | 0 | 1 | 0 | 0 | 3 | 0.8 | 0.8 | 1.4 | 4.8 | 1.4 | 2.2 |
| $q_{4,1}$ | 0 | 0 | 0 | 2 | 0.8 | −0.2 | 1.4 | 2.8 | 1.4 | 2.2 | 1.8 |
| $q_{4,2}$ | 0 | 0 | 2 | 0.8 | −0.2 | 1.4 | 2.8 | 1.4 | 2.2 | 1.8 | 4.6 |
| $q_{4,3}$ | 1 | 2 | 0.8 | −0.2 | 1.4 | 2.8 | 1.4 | 2.2 | 1.8 | 4.6 | 2 |
| $q_{5,0}$ | 0 | 0 | 0 | 0 | 1 | 2 | 1.4 | −0.2 | 0.8 | 2.4 | 1.8 |
| $q_{5,1}$ | 0 | 0 | 0 | 0 | 2 | 0.4 | −0.2 | −0.2 | 2.4 | 1.8 | 1.2 |
| $q_{5,2}$ | 0 | 0 | 0 | 2 | 0.4 | −0.2 | −0.2 | 2.4 | 1.8 | 1.2 | 0.8 |
| $q_{5,3}$ | 0 | 0 | 2 | 0.4 | −0.2 | −0.2 | 2.4 | 1.8 | 1.2 | 0.8 | 4.2 |
| $q_{5,4}$ | 1 | 2 | 0.4 | −0.2 | −0.2 | 2.4 | 1.8 | 1.2 | 0.8 | 4.2 | 2.2 |

FIG.19

1

| state | $t_0$ | $t_1$ | $t_2$ | $t_3$ | $t_4$ | $t_5$ | $t_6$ | $t_7$ | $t_8$ | $t_9$ |
|---|---|---|---|---|---|---|---|---|---|---|
| $q_{3,0}$ | N/A | $q_{3,1}$ | $q_{3,1}$ | $q_{3,1}$ | $q_{3,1}$ | $q_{3,1}$ | $q_{3,1}$ | $q_{3,1}$ | $q_{3,1}$ | $q_{3,1}$ |
| $q_{3,1}$ | N/A | $q_{3,2}$ | $q_{3,2}$ | $q_{3,2}$ | $q_{3,2}$ | $q_{3,2}$ | $q_{3,2}$ | $q_{3,2}$ | $q_{3,2}$ | $q_{3,2}$ |
| $q_{3,2}$ | N/A | $q_{4,0}$ | $q_{3,0}$ | $q_{3,0}$ | $q_{4,0}$ | $q_{4,0}$ | $q_{3,0}$ | $q_{3,0}$ | $q_{4,0}$ | $q_{3,0}$ |
| $q_{4,0}$ | N/A | $q_{4,1}$ | $q_{4,1}$ | $q_{4,1}$ | $q_{4,1}$ | $q_{4,1}$ | $q_{4,1}$ | $q_{4,1}$ | $q_{4,1}$ | $q_{4,1}$ |
| $q_{4,1}$ | N/A | $q_{4,2}$ | $q_{4,2}$ | $q_{4,2}$ | $q_{4,2}$ | $q_{4,2}$ | $q_{4,2}$ | $q_{4,2}$ | $q_{4,2}$ | $q_{4,2}$ |
| $q_{4,2}$ | N/A | $q_{4,3}$ | $q_{4,3}$ | $q_{4,3}$ | $q_{4,3}$ | $q_{4,3}$ | $q_{4,3}$ | $q_{4,3}$ | $q_{4,3}$ | $q_{4,3}$ |
| $q_{4,3}$ | N/A | $q_{4,0}$ | $q_{4,0}$ | $q_{3,0}$ | $q_{4,0}$ | $q_{5,0}$ | $q_{3,0}$ | $q_{3,0}$ | $q_{4,0}$ | $q_{3,0}$ |
| $q_{5,0}$ | N/A | $q_{5,1}$ | $q_{5,1}$ | $q_{5,1}$ | $q_{5,1}$ | $q_{5,1}$ | $q_{5,1}$ | $q_{5,1}$ | $q_{5,1}$ | $q_{5,1}$ |
| $q_{5,1}$ | N/A | $q_{5,2}$ | $q_{5,2}$ | $q_{5,2}$ | $q_{5,2}$ | $q_{5,2}$ | $q_{5,2}$ | $q_{5,2}$ | $q_{5,2}$ | $q_{5,2}$ |
| $q_{5,2}$ | N/A | $q_{5,3}$ | $q_{5,3}$ | $q_{5,3}$ | $q_{5,3}$ | $q_{5,3}$ | $q_{5,3}$ | $q_{5,3}$ | $q_{5,3}$ | $q_{5,3}$ |
| $q_{5,3}$ | N/A | $q_{5,4}$ | $q_{5,4}$ | $q_{5,4}$ | $q_{5,4}$ | $q_{5,4}$ | $q_{5,4}$ | $q_{5,4}$ | $q_{5,4}$ | $q_{5,4}$ |
| $q_{5,4}$ | N/A | $q_{4,0}$ | $q_{5,0}$ | $q_{5,0}$ | $q_{4,0}$ | $q_{5,0}$ | $q_{5,0}$ | $q_{4,0}$ | $q_{4,0}$ | $q_{5,0}$ |

SOUND SIGNAL ANALYSIS APPARATUS, SOUND SIGNAL ANALYSIS METHOD AND SOUND SIGNAL ANALYSIS PROGRAM

BACKGROUND OF THE INVENTION

1. Field of the Invention

The present invention relates to a sound signal analysis apparatus, a sound signal analysis method and a sound signal analysis program for receiving sound signals indicative of a musical piece and detecting beat positions (beat timing) and tempo of the musical piece.

2. Description of the Related Art

Conventionally, there are sound signal analysis apparatuses which receive sound signals indicative of a musical piece and detect beat positions and tempo of the musical piece, as described in Japanese Unexamined Patent Publication No. 2009-265493, for example.

SUMMARY OF THE INVENTION

First, the conventional sound signal analysis apparatus of the above-described Japanese Unexamined Patent Publication calculates beat index sequence as candidate beat positions in accordance with changes in strength (amplitude) of sound signals. Then, in accordance with the calculated result of beat index sequence, the sound signal analysis apparatus detects tempo of the musical piece. In a case where the accuracy with which the beat index sequence is detected is low, therefore, the accuracy with which the tempo is detected is also decreased.

The present invention was accomplished to solve the above-described problem, and an object thereof is to provide a sound signal analysis apparatus which can detect beat positions and changes in tempo in a musical piece with high accuracy. As for descriptions about respective constituent features of the present invention, furthermore, reference letters of corresponding components of an embodiment described later are provided in parentheses to facilitate the understanding of the present invention. However, it should not be understood that the constituent features of the present invention are limited to the corresponding components indicated by the reference letters of the embodiment.

In order to achieve the above-described object, it is a feature of the present invention to provide a sound signal analysis apparatus including sound signal input portion (S12) for inputting a sound signal indicative of a musical piece; feature value calculation portion (S165, S167) for calculating a first feature value (XO) indicative of a feature relating to existence of a beat in one of sections of the musical piece and a second feature value (XB) indicative of a feature relating to tempo in one of the sections of the musical piece; and estimation portion (S17, S18) for concurrently estimating a beat position and a change in tempo in the musical piece by selecting, from among a plurality of probability models described as sequences of states ($q_{b,n}$) classified according to a combination of a physical quantity (n) relating to existence of a beat in one of the sections of the musical piece and a physical quantity (b) relating to tempo in one of the sections of the musical piece, a probability model whose sequence of observation likelihoods (L) each indicative of a probability of concurrent observation of the first feature value and the second feature value in corresponding one of the sections of the musical piece satisfies a certain criterion.

In this case, the estimation portion may concurrently estimate a beat position and a change in tempo in the musical piece by selecting a probability model of the most likely sequence of observation likelihoods from among the plurality of probability models.

In this case, the estimation portion may have first probability output portion (S172) for outputting, as a probability of observation of the first feature value, a probability calculated by assigning the first feature value as a probability variable of a probability distribution function defined according to the physical quantity relating to existence of beat.

In this case, as a probability of observation of the first feature value, the first probability output portion may output a probability calculated by assigning the first feature value as a probability variable of any one of (including but not limited to the any one of) normal distribution, gamma distribution and Poisson distribution defined according to the physical quantity relating to existence of beat.

In this case, the estimation portion may have second probability output portion for outputting, as a probability of observation of the second feature value, goodness of fit of the second feature value to a plurality of templates provided according to the physical quantity relating to tempo.

In this case, the estimation portion may have second probability output portion for outputting, as a probability of observation of the second feature value, a probability calculated by assigning the second feature value as a probability variable of probability distribution function defined according to the physical quantity relating to tempo.

In this case, as a probability of observation of the second feature value, the second probability output portion may output a probability calculated by assigning the first feature value as a probability variable of any one of (including but not limited to the any one of) multinomial distribution, Dirichlet distribution, multidimensional normal distribution, and multidimensional Poisson distribution defined according to the physical quantity relating to existence of beat.

In this case, furthermore, the sections of the musical piece correspond to frames, respectively, formed by dividing the input sound signal at certain time intervals; and the feature value calculation portion may have first feature value calculation portion (S165) for calculating amplitude spectrum (A) for each of the frames, applying a plurality of window functions (BPF) each having a different frequency band ($w_k$) to the amplitude spectrum to generate amplitude spectrum (M) for each frequency band, and outputting, as the first feature value, a value calculated on the basis of a change in amplitude spectrum provided for the each frequency band between the frames; and second feature value calculation portion (S167) having a filter (FBB) that outputs a value in response to each input of a value corresponding to a frame, that has keeping portion ($d_b$) for keeping the output value for a certain period of time, and that combines the input value and the value kept for the certain period of time at a certain ratio, and output the combined value, the second feature value calculation portion outputting, as a sequence of the second feature values, a data sequence obtained by inputting, to the filter, a data sequence obtained by reversing a time sequence of a data sequence obtained by inputting a sequence of the first feature values to the filter.

The sound signal analysis apparatus configured as above can select a probability model satisfying a certain criterion (a probability model such as the most likely probability model or a maximum a posteriori probability model) of a sequence of observation likelihoods calculated by use of the first feature values indicative of feature relating to existence of beat and the second feature values indicative of feature relating to tempo to concurrently (jointly) estimate beat positions and changes in tempo in a musical piece. Unlike the above-described related art, therefore, the sound signal analysis apparatus of the present invention will not present a problem that a low accuracy of estimation of either beat positions or tempo causes low accuracy of estimation of the other. As a result, the sound signal analysis apparatus can enhance estimation accuracy of beat positions and changes in tempo in a musical piece, compared with the related art.

Furthermore, it is a further feature of the present invention that the sound signal analysis apparatus further includes correction information input portion (11, S23) for inputting correction information indicative of corrected content of one of or both of a beat position and a change in tempo in the musical piece; observation likelihood correction portion (S23) for correcting the observation likelihoods in accordance with the input correction information; and re-estimation portion (S23, S18) for re-estimating a beat position and a change in tempo in the musical piece concurrently by selecting, by use of the estimation portion, a probability model whose sequence of the corrected observation likelihoods satisfies the certain criterion from among the plurality of probability models.

In accordance with user's input correction information, as a result, the sound signal analysis apparatus corrects observation likelihoods, and re-estimates beat positions and changes in tempo in a musical piece in accordance with the corrected observation likelihoods. Therefore, the sound signal analysis apparatus re-calculates (re-selects) states of one or more frames situated in front of and behind the corrected frame. Consequently, the sound signal analysis apparatus can obtain estimation results which bring about smooth changes in beat intervals (that is, tempo) from the corrected frame to the one or more frames situated in front of and behind the corrected frame.

Furthermore, the present invention can be embodied not only as the invention of the sound signal analysis apparatus, but also as an invention of a sound signal analysis method and an invention of a computer program applied to the apparatus.

BRIEF DESCRIPTION OF THE DRAWINGS

FIG. 13 is a chart indicative of calculated results of observation likelihood of onset feature value;

FIG. 14 is a chart indicative of a configuration of templates;

FIG. 17 is a chart indicative of calculated results of log observation likelihood;

FIG. 18 is a chart indicative of results of calculation of likelihoods of states selected as a sequence of the maximum likelihoods of the states of respective frames when the onset feature values and the BPM feature values are observed from the top frame;

FIG. 19 is a chart indicative of calculated results of states before transition;

DESCRIPTION OF THE PREFERRED EMBODIMENT

Figure 1:
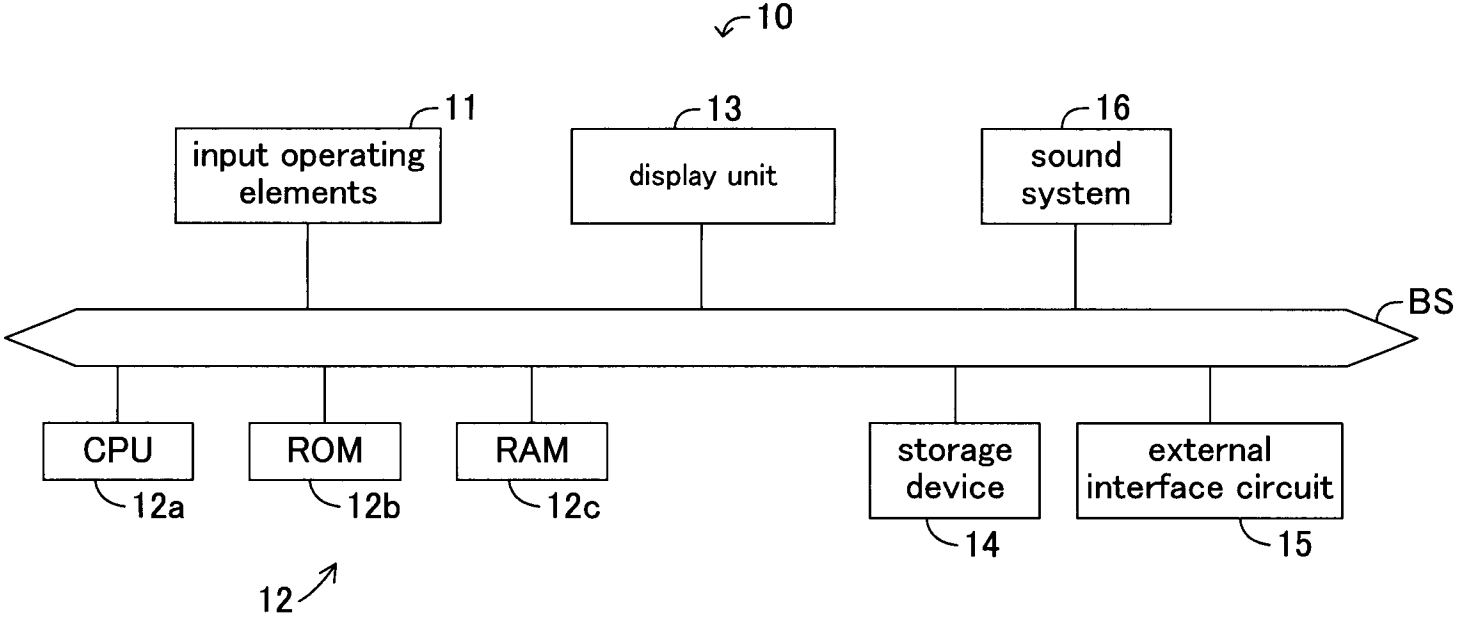
FIG. 1 is a block diagram indicative of an entire configuration of a sound signal analysis apparatus according to an embodiment of the present invention.

A sound signal analysis apparatus 10 according to an embodiment of the present invention will now be described. As described below, the sound signal analysis apparatus 10 receives sound signals indicative of a musical piece, and detects beat positions and changes in tempo of the musical piece. As indicated in FIG. 1, the sound signal analysis apparatus 10 has input operating elements 11, a computer portion 12, a display unit 13, a storage device 14, an external interface circuit 15 and a sound system 16, with these components being connected with each other through a bus BS.

The input operating elements 11 are formed of switches capable of on/off operation (e.g., a numeric keypad for inputting numeric values), volumes or rotary encoders capable of rotary operation, volumes or linear encoders capable of sliding operation, a mouse, a touch panel and the like. These operating elements are manipulated with a player's hand to select a musical piece to analyze, to start or stop analysis of sound signals, to reproduce or stop the musical piece (to output or stop sound signals from the later-described sound system 16), or to set various kinds of parameters on analysis of sound signals. In response to the player's manipulation of the input operating elements 11, operational information indicative of the manipulation is supplied to the later-described computer portion 12 via the bus BS.

The computer portion 12 is formed of a CPU 12*a*, a ROM 12*b* and a RAM 12*c* which are connected to the bus BS. The CPU 12*a* reads out a sound signal analysis program and its subroutines which will be described in detail later from the ROM 12*b*, and executes the program and subroutines. In the ROM 12*b*, not only the sound signal analysis program and its subroutines but also initial setting parameters and various kinds of data such as graphic data and text data for generating display data indicative of images which are to be displayed on the display unit 13 are stored. In the RAM 12*c*, data necessary for execution of the sound signal analysis program is temporarily stored.

The display unit 13 is formed of a liquid crystal display (LCD). The computer portion 12 generates display data indicative of content which is to be displayed by use of graphic data, text data and the like, and supplies the generated display data to the display unit 13. The display unit 13 displays images on the basis of the display data supplied from the computer portion 12. At the time of selection of a musical piece to analyze, for example, a list of titles of musical pieces is displayed on the display unit 13. At the time of completion of analysis, for example, a beat/tempo information list indicative of beat positions and changes in tempo and its graphs (see FIG. 20 to FIG. 23) are displayed.

The storage device 14 is formed of high-capacity nonvolatile storage media such as HDD, FDD, CD-ROM, MO and DVD, and their drive units. In the storage device 14, sets of musical piece data indicative of musical pieces, respectively, are stored. Each set of musical piece data is formed of a plurality of sample values obtained by sampling a musical piece at certain sampling periods (1/44100 s, for example), while the sample values are sequentially recorded in successive addresses of the storage device 14. Each set of musical piece data also includes title information representative of the title of the musical piece and data size information representative of the amount of the set of musical piece data. The sets of musical piece data may be previously stored in the storage device 14, or may be retrieved from an external apparatus via the external interface circuit 15 which will be described later. The musical piece data stored in the storage device 14 is read by the CPU 12*a* to analyze beat positions and changes in tempo in the musical piece.

The external interface circuit 15 has a connection terminal which enables the sound signal analysis apparatus 10 to connect with an external apparatus such as an electronic musical apparatus and a personal computer. The sound signal analysis apparatus 10 can also connect to a communication network such as a LAN (Local Area Network) and the Internet via the external interface circuit 15.

The sound system 16 has a D/A converter for converting musical piece data to analog tone signals, an amplifier for amplifying the converted analog tone signals, and a pair of right and left speakers for converting the amplified analog tone signals to acoustic sound signals and outputting the acoustic sound signals. In response to user's instructions for reproducing a musical piece which is to analyze by use of the input operating elements 11, the CPU 12*a* supplies musical piece data which is to analyze to the sound system 16. As a result, the user can listen to the musical piece which the user intends to analyze.

Figure 2:
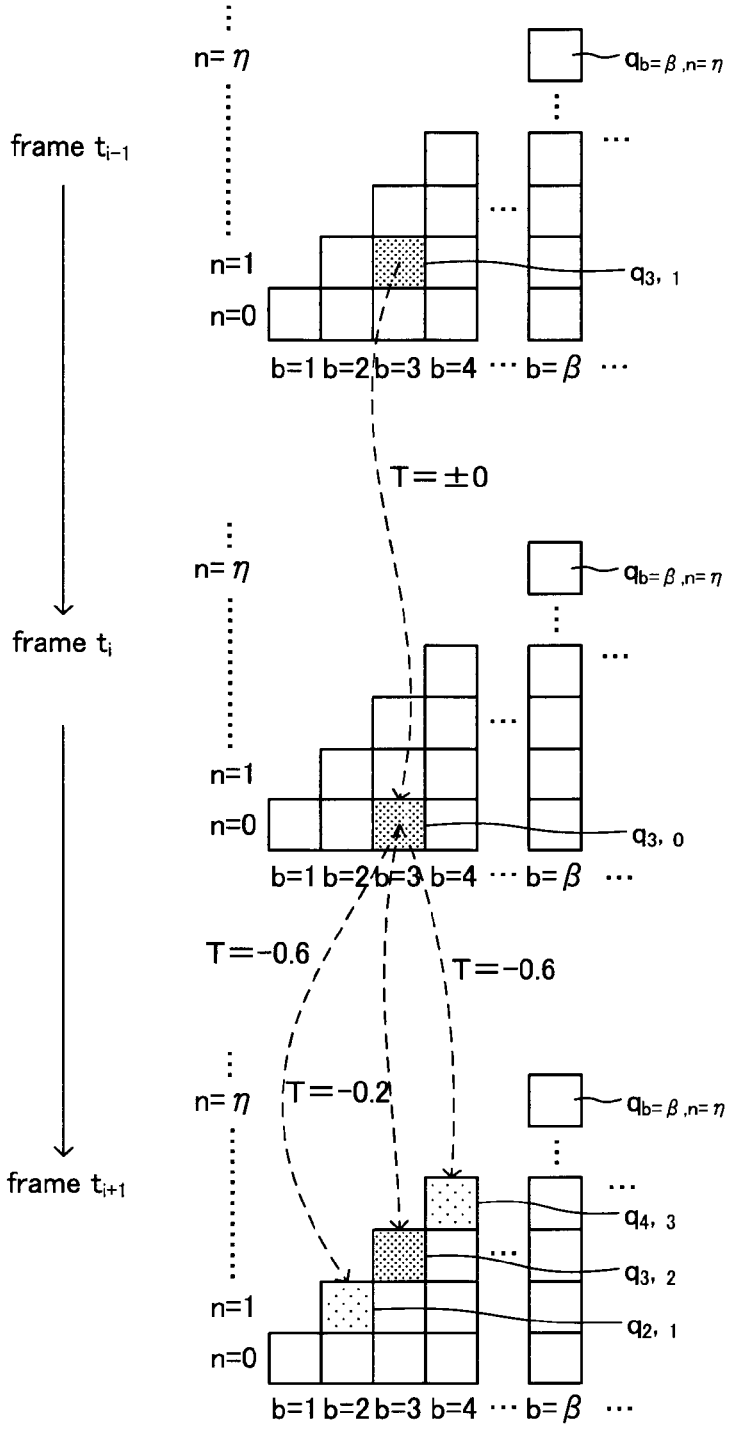
FIG. 2 is a conceptual illustration of a probability model.

Next, the operation of the sound signal analysis apparatus 10 configured as described above will be explained. First, the operation of the sound signal analysis apparatus 10 will be briefly explained. The musical piece which is to analyze is separated into a plurality of frames $t_i\{i=0, 1, \ldots, last\}$. For each frame $t_h$ furthermore, onset feature values XO representative of feature relating to existence of beat and BPM feature values XB representative of feature relating to tempo are calculated. From among probability models (Hidden Markov Models) described as sequences of states $q_{b,\ n}$ classified according to combination of a value of beat period b (value proportional to reciprocal of tempo) in a frame $t_i$ and a value of the number of frames n between the next beat, a probability model having the most likely sequence of observation likelihoods representative of probability of concurrent observation of the onset feature value XO and BPM feature value XB as observed values is selected (see FIG. 2). As a result, beat positions and changes in tempo of the musical piece subjected to analysis are detected. The beat period b is represented by the number of frames. Therefore, a value of the beat period b is an integer which satisfies "$1 \le b \le b_{max}$", while in a state where a value of the beat period b is "β", a value of the number of frames n is an integer which satisfies "$0 \le n < \beta$".

Figure 3:
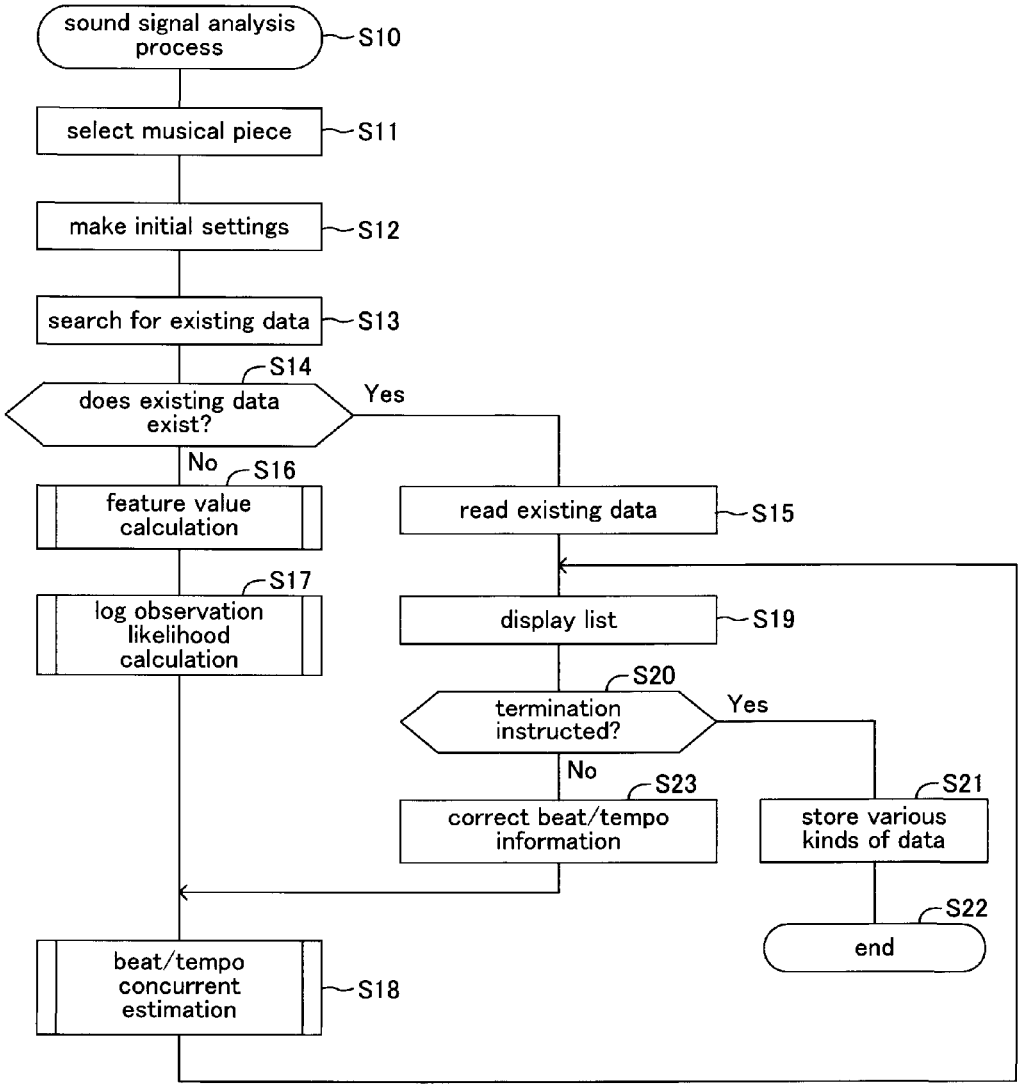
FIG. 3 is a flowchart of a sound signal analysis program.

Next, the operation of the sound signal analysis apparatus 10 will be explained concretely. When the user turns on a power switch (not shown) of the sound signal analysis apparatus 10, the CPU 12*a* reads out a sound signal analysis program of FIG. 3 from the ROM 12*b*, and executes the program.

The CPU 12*a* starts a sound signal analysis process at step S10. At step S11, the CPU 12*a* reads title information included in the sets of musical piece data stored in the storage device 14, and displays a list of titles of the musical pieces on the display unit 13. Using the input operating elements 11, the user selects a set of musical piece data which the user desires to analyze from among the musical pieces displayed on the display unit 13. The sound signal analysis process may be configured such that when the user selects a set of musical piece data which is to analyze at step S11, a part of or the entire of the musical piece represented by the set of musical piece data is reproduced so that the user can confirm the content of the musical piece data.

At step S12, the CPU 12*a* makes initial settings for sound signal analysis. More specifically, the CPU 12*a* keeps a storage area appropriate to data size information of the selected set of musical piece data in the RAM 12*c*, and reads the selected set of musical piece data into the kept storage area. Furthermore, the CPU 12*a* keeps an area for temporarily storing a beat/tempo information list, the onset feature values XO, the BPM feature values XB and the like indicative of analyzed results in the RAM 12*c*.

The results analyzed by the program are to be stored in the storage device 14, which will be described in detail later (step S21). If the selected musical piece has been already analyzed by this program, the analyzed results are stored in the storage device 14. At step S13, therefore, the CPU 12*a* searches for existing data on the analysis of the selected musical piece (hereafter, simply referred to as existing data). If there is existing data, the CPU 12*a* determines "Yes" at step S14 to read the existing data into the RAM 12*c* at step S15 to proceed to step S19 which will be described later. If there is no existing data, the CPU 12*a* determines "No" at step S14 to proceed to step S16.

Figure 4:
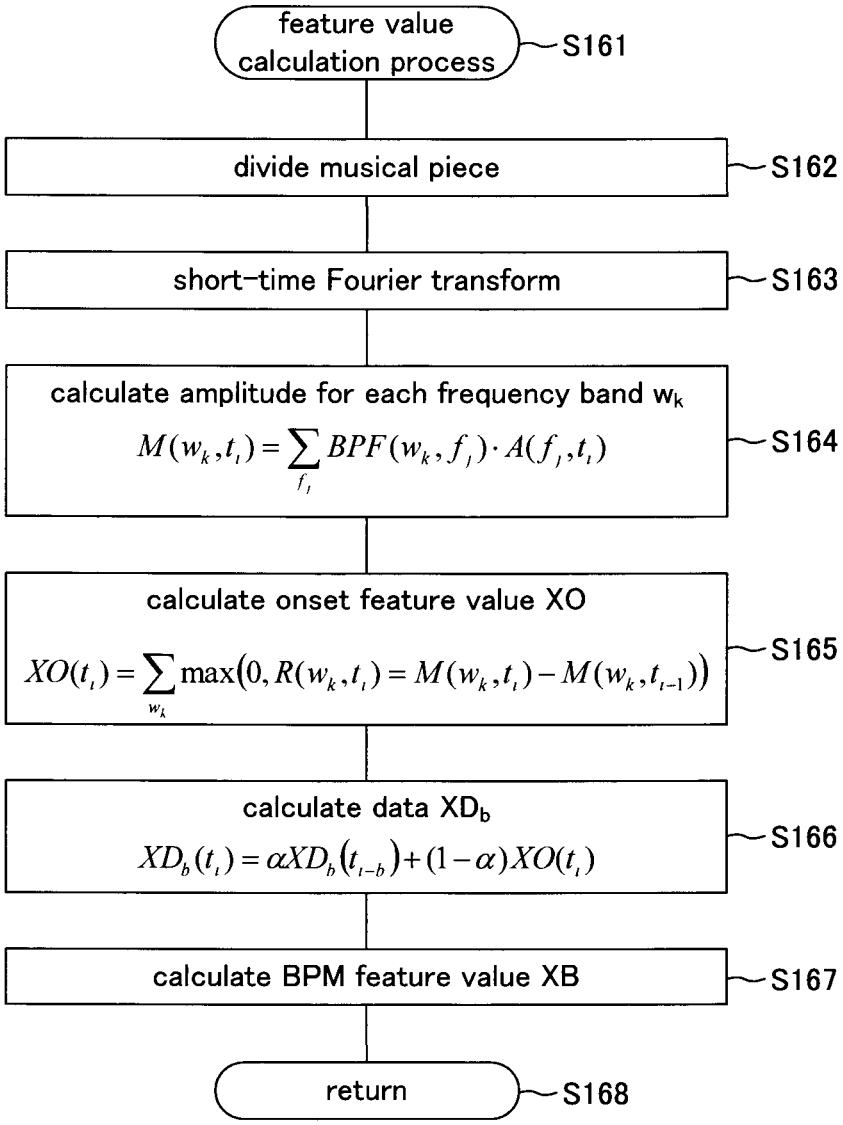
FIG. 4 is a flowchart of a feature value calculation program.

At step S16, the CPU 12*a* reads out a feature value calculation program indicated in FIG. 4 from the ROM 12*b*, and executes the program. The feature value calculation program is a subroutine of the sound signal analysis program.

Figure 5:
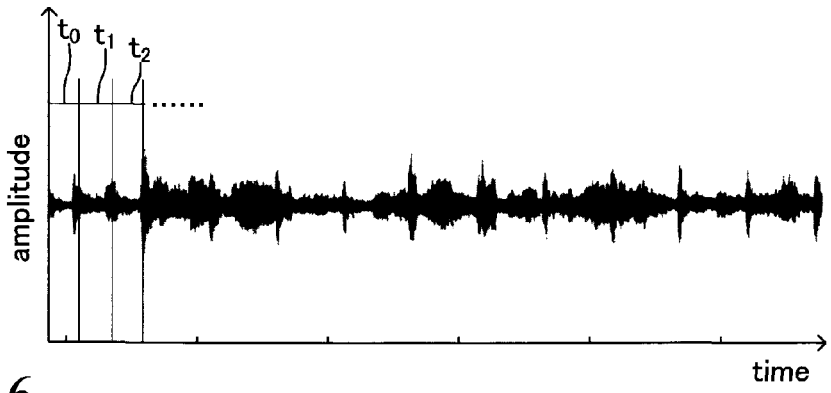
FIG. 5 is a graph indicative of a waveform of a sound signal to analyze.

At step S161, the CPU 12*a* starts a feature value calculation process. At step S162, the CPU 12*a* divides the selected musical piece at certain time intervals as indicated in FIG. 5 to separate the selected musical piece into a plurality of frames $t_i\{i=0, 1, \ldots, last\}$. The respective frames have the same length. For easy understanding, assume that each frame has 125 ms in this embodiment. Since the sampling period of each musical piece is 1/44100 s as described above, each frame is formed of approximately 5000 sample values. As explained below, furthermore, the onset feature value XO and the BPM (beats per minute) feature value XB are calculated for each frame.

Figure 6:
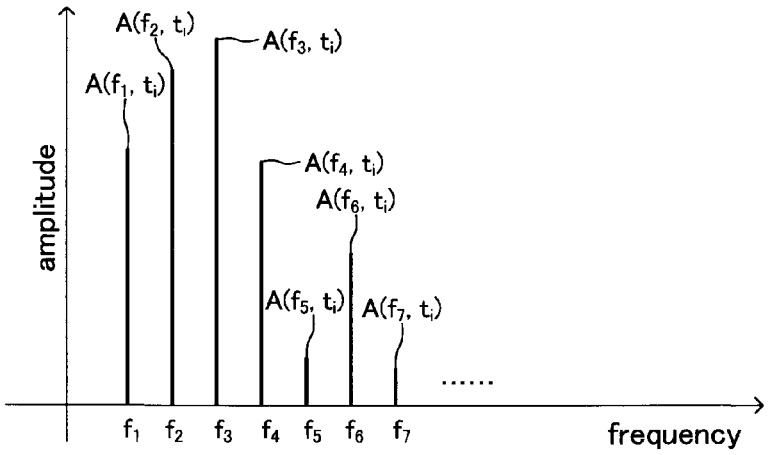
FIG. 6 is a diagram indicative of sound spectrum obtained by short-time Fourier transforming one frame.
Figure 7:
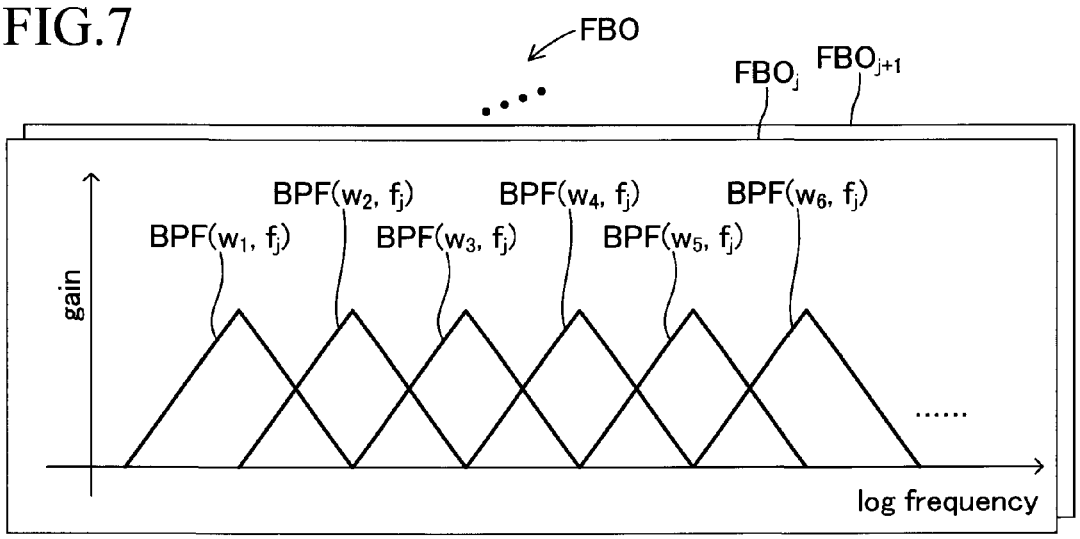
FIG. 7 is a diagram indicative of characteristics of band pass filters.
Figure 8:
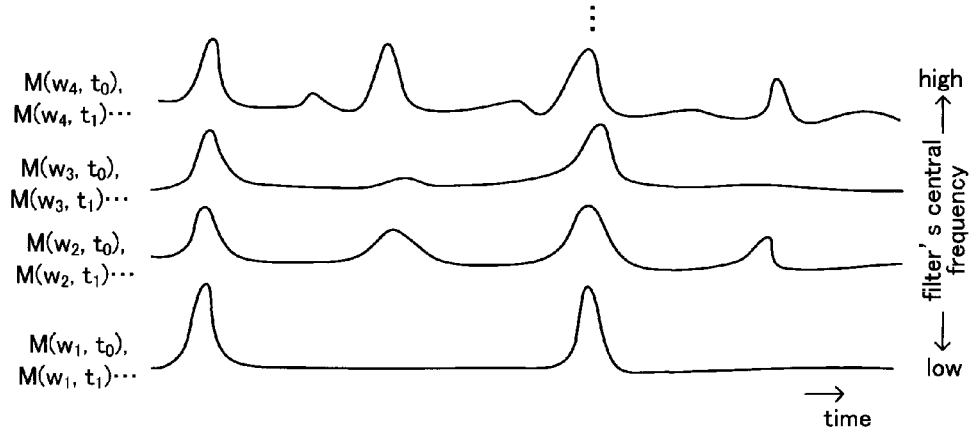
FIG. 8 is a graph indicative of time-variable amplitudes of respective frequency bands.

At step S163, the CPU 12*a* performs a short-time Fourier transform for each frame to figure out an amplitude $A(f_j, t_i)$ of each frequency bin $f_j$ $\{j=1, 2, \ldots\}$ as indicated in FIG. 6. At step S164, the CPU 12*a* filters the amplitudes $A(f_1, t_i)$, $A(f_2, t_i)$ . . . by filter banks $FBO_j$ provided for frequency bins $f_j$, respectively, to figure out amplitudes $M(w_k, t_i)$ of certain frequency bands $w_k$ $\{k=1, 2, \ldots\}$, respectively. The filter bank $FBO_j$ for the frequency bin $f_j$ is formed of a plurality of band path filters $BPF(w_k, f_1)$ each having a different central frequency of passband as indicated in FIG. 7. The central frequencies of the band pass filters $BPF(w_k, f_j)$ which form the filter band $FBO_j$ are spaced evenly on a log frequency scale, while the band pass filters $BPF(w_k, f_j)$ have the same passband width on the log frequency scale. Each bandpass filter $BPF(w_k, f_j)$ is configured such that the gain gradually decreases from the central frequency of the passband toward the lower limit frequency side and the upper limit frequency side of the passband. As indicated in step S164 of FIG. 4, the CPU 12*a* multiplies the amplitude A ($f_1$, $t_i$) by the gain of the bandpass filter BPF ($w_k$, $f_i$) for each frequency bin $f_j$. Then, the CPU 12*a* combines the summed results calculated for the respective frequency bins $f_j$. The combined result is referred to as an amplitude M ($w_k$, $t_i$). An example sequence of the amplitudes M calculated as above is indicated in FIG. 8.

Figure 9:
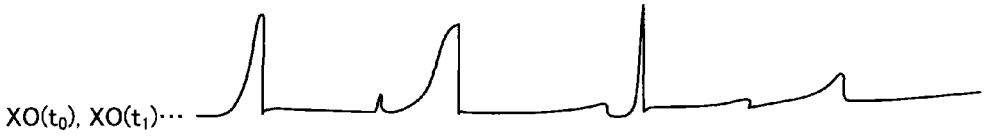
FIG. 9 is a graph indicative of time-variable onset feature value.

At step S165, the CPU 12*a* calculates the onset feature value XO ($t_i$) of frame $t_i$ on the basis of the time-varying amplitudes M. As indicated in step S165 of FIG. 4, more specifically, the CPU 12*a* figures out an increased amount R ($w_k$, $t_i$) of the amplitude M from frame $t_{i-1}$ to frame $t_i$ for each frequency band $w_k$. However, in a case where the amplitude M ($w_k$, $t_{i-1}$) of frame $t_{i-1}$ is identical with the amplitude M ($w_k$, $t_i$) of frame $t_i$, or in a case where the amplitude M ($w_k$, $t_i$) of frame $t_i$ is smaller than the amplitude M ($w_k$, $t_{i-1}$) of frame $t_{i-1}$, the increased amount R ($w_k$, $t_i$) is assumed to be "0". Then, the CPU 12*a* combines the increased amounts R ($w_k$, $t_i$) calculated for the respective frequency bands $w_1$, $w_2$, . . . . The combined result is referred to as the onset feature value XO ($t_i$). A sequence of the above-calculated onset feature values XO is exemplified in FIG. 9. In musical pieces, generally, beat positions have a large tone volume. Therefore, the greater the onset feature value XO ($t_i$) is, the higher the possibility that the frame $t_i$ has a beat is.

Figure 10:
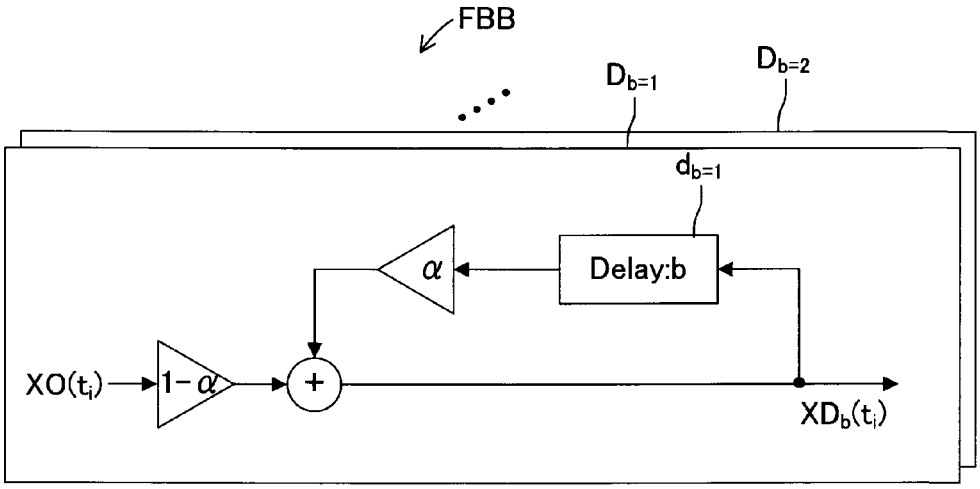
FIG. 10 is a block diagram of comb filters.

By use of the onset feature values XO ($t_0$), XO ($t_1$), . . . , the CPU 12*a* then calculates the BPM feature value XB for each frame $t_i$. The BPM feature value XB ($t_i$) of frame $t_i$ is represented as a set of BPM feature values $XB_{b=1,2,\ldots}$ ($t_i$) calculated in each beat period b (see FIG. 11). At step S166, the CPU 12*a* inputs the onset feature values XO ($t_0$), XO($t_1$), . . . in this order to a filter bank FBB to filter the onset feature values XO. The filter bank FBB is formed of a plurality of comb filters $D_b$ provided to correspond to the beat periods b, respectively. When the onset feature value XO($t_i$) of frame $t_i$ is input to the comb filter $D_{b=\beta}$, the comb filter $D_{b=\beta}$ combines the input onset feature value XO($t_i$) with data $XD_{b=\beta}$ ($t_{i-\beta}$) which is the output for the onset feature value XO($t_{i-\beta}$) of frame $t_{i-\beta}$ which precedes the frame $t_i$ by "β" at a certain proportion, and outputs the combined result as data $XD_{b=\beta}$($t_i$) of frame $t_i$ (see FIG. 10). In other words, the comb filter $D_{b=\beta}$ has a delay circuit $d_{b=\beta}$ which serves as holding portion for holding data $XD_{b=\beta}$ for a time period equivalent to the number of frames 13. As described above, by inputting the sequence XO(t){=XO($t_0$), XO($t_1$), . . . } of the onset feature values XO to the filter bank FBB, the sequence $XD_b$(t){=$XD_b$($t_0$), $XD_b$ ($t_1$), . . . } of data $XD_b$ can be figured out.

At step S167, the CPU 12*a* obtains the sequence $XB_b$(t){=$XB_b$($t_0$), $XB_b$($t_1$), . . . } of the BPM feature values by inputting a data sequence obtained by reversing the sequence $XD_b$(t) of data $XD_b$ in time series to the filter bank FBB. As a result, the phase shift between the phase of the onset feature values XO($t_0$), XO ($t_1$), . . . and the phase of the BPM feature values $XB_b$($t_0$), $XB_b$($t_1$), . . . can be made "0". The BPM feature values XB($t_i$) calculated as above are exemplified in FIG. 11. As described above, the BPM feature value $XB_b$(t) is obtained by combining the onset feature value XO($t_i$) with the BPM feature value $XB_b$($t_{i-b}$) delayed for the time period (i.e., the number b of frames) equivalent to the value of the beat period b at the certain proportion. In a case where the onset feature values XO($t_0$), XO ($t_1$), . . . have peaks with time intervals equivalent to the value of the beat period b, therefore, the value of the BPM feature value $XB_b$(t) increases. Since the tempo of a musical piece is represented by the number of beats per minute, the beat period b is proportional to the reciprocal of the number of beats per minute. In the example shown in FIG. 11, for example, among the BPM feature values $XB_b$, the BPM feature value $XB_b$ with the value of the beat period b being "4" (BPM feature value $XB_{b=4}$) is the largest. In this example, therefore, there is a high possibility that a beat exists every four frames. Since this embodiment is designed to define the length of each frame as 125 ms, the interval between the beats is 0.5 s in this case. In other words, the tempo is 120 BPM (=60 s/0.5 s).

At step S168, the CPU 12*a* terminates the feature value calculation process to proceed to step S17 of the sound signal analysis process (main routine).

Figure 12:
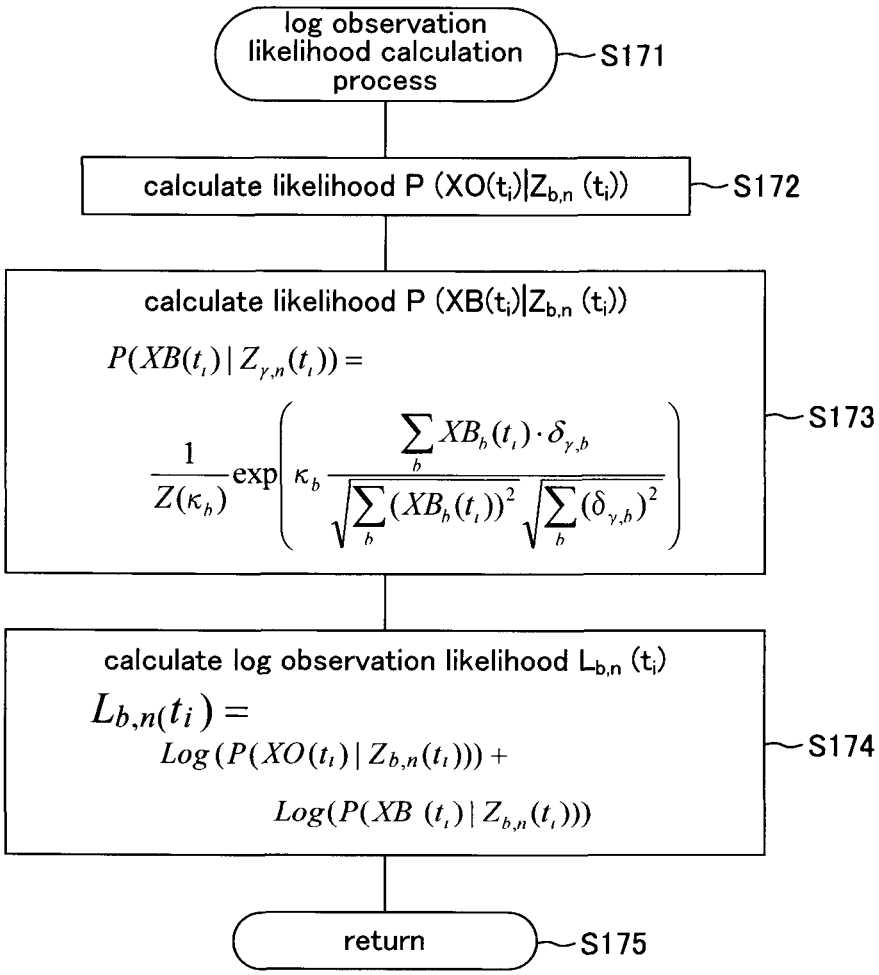
FIG. 12 is a flowchart of a log observation likelihood calculation program.

At step S17, the CPU 12*a* reads out a log observation likelihood calculation program indicated in FIG. 12 from the ROM 12*b*, and executes the program. The log observation likelihood calculation program is a subroutine of the sound signal analysis process.

At step S171, the CPU 12*a* starts the log observation likelihood calculation process. Then, as explained below, a likelihood P (XO($t_i$)|$Z_{b,n}$($t_i$)) of the onset feature value XO($t_i$) and a likelihood P (XB($t_i$)|$Z_{b,n}$($t_i$)) of the BPM feature value XB($t_i$) are calculated. The above-described "$Z_{b=\beta,n=\eta}$ ($t_i$)" represents the occurrence only of a state $q_{b=\beta,n=\eta}$ where the value of the beat period b is "β" in frame $t_h$ with the value of the number n of frames between the next beat is "η". In frame $t_i$, more specifically, the state $q_{b=\beta,n=\eta}$ and a state $q_{b\neq\beta,n\neq\eta}$ cannot occur concurrently. Therefore, the likelihood P (XO ($t_i$)|$Z_{b=\beta,n=\eta}$ ($t_i$)) represents the probability of observation of the onset feature value XO($t_i$) on condition that the value of the beat period b is "β" in frame $t_i$, with the value of the number n of frames between the next beat being "η". Furthermore, the likelihood P (XB($t_i$)|$Z_{b=\beta,n=\eta}$ ($t_i$)) represents the probability of observation of the BPM feature value XB($t_i$) on condition that the value of the beat period b is "β" in frame $t_i$, with the value of the number n of frames between the next beat being "η".

At step S172, the CPU 12*a* calculates the likelihood P (XO($t_i$)|$Z_{b,n}$($t_i$)). Assume that if the value of the number n of frames between the next beat is "0", the onset feature values XO are distributed in accordance with the first normal distribution with a mean value of "3" and a variance of "1". In other words, the value obtained by assigning the onset feature value XO($t_i$) as a random variable of the first normal distribution is the likelihood P (XO($t_i$)|$Z_{b,n=0}$ ($t_i$)). Furthermore, assume that if the value of the beat period b is "β", with the value of the number n of frames between the next beat being "β/2", the onset feature values XO are distributed in accordance with the second normal distribution with a mean value of "1" and a variance of "1". In other words, the value obtained by assigning the onset feature value XO($t_i$) as a random variable of the second normal distribution is the likelihood P (XO($t_i$)|$Z_{b=\beta,n=\beta/2}$ ($t_i$)). Furthermore, assume that if the value of the number n of frames between the next beat is neither "0" nor "β/2", the onset feature values XO are distributed in accordance with the third normal distribution with a mean value of "0" and a variance of "1". In other words, the value obtained by assigning the onset feature value XO($t_i$) as a random variable of the third normal distribution is the likelihood P (XO($t_i$)|$Z_{b,n\neq0,\beta/2}$ ($t_i$)).

FIG. 13 indicates example results of log calculation of the likelihood P (XO($t_i$)|$Z_{b=6,n}$ ($t_i$)) with a sequence of onset feature values XO of {10, 2, 0.5, 5, 1, 0, 3, 4, 2}. As indicated in FIG. 13, the greater onset feature value XO the frame $t_i$ has, the greater the likelihood P (XO($t_i$)|$Z_{b,n=0}$ ($t_i$)) is, compared with the likelihood P (XO($t_i$)|$Z_{b,n\neq0}$ ($t_i$)). As described above, the probability models (the first to third normal distributions and their parameters (mean value and variance)) are set such that the greater onset feature value XO the frame $t_i$ has, the higher the probability of existence of beat with the value of the number n of frames of "0" is. The parameter values of the first to third normal distributions are not limited to those of the above-described embodiment. These parameter values may be determined on the basis of repeated experiments, or by machine learning. In this example, normal distribution is used as probability distribution function for calculating the likelihood P of the onset feature value XO. However, a different function (e.g., gamma distribution or Poisson distribution) may be used as probability distribution function.

At step S173, the CPU 12*a* calculates the likelihood P $(XB(t_i)|Z_{b,n}(t_i))$. The likelihood P $(XB(t_i)|Z_{b=\gamma,n}(t_i))$ is equivalent to goodness of fit of the BPM feature value $XB(t_i)$ with respect to template $TP_\gamma\{\gamma=1, 2, \ldots\}$ indicated in FIG. 14. More specifically, the likelihood P $(XB(t_i)|Z_{b=\gamma,n}(t_i))$ is equivalent to an inner product between the BPM feature value $XB(t_i)$ and the template $TP_\gamma\{\gamma=1, 2, \ldots\}$ (see an expression of step S173 of FIG. 12). In this expression, "$\kappa_b$" is a factor which defines weight of the BPM feature value XB with respect to the onset feature value XO. In other words, the greater the $\kappa_b$ is, the more the BPM feature value XB is valued in a later-described beat/tempo concurrent estimation process as a result. In this expression, furthermore, "$Z(\kappa_b)$" is a normalization factor which depends on $\kappa_b$. As indicated in FIG. 14, the templates $TP_\gamma$ are formed of factors $\delta_{\gamma,b}$ which are to be multiplied by the BPM feature values $XB_b(t_i)$ which form the BPM feature value $XB(t_i)$. The templates $TP_\gamma$ are designed such that the factor $\delta_{\gamma,\gamma}$ is a global maximum, while each of the factor $\delta_{\gamma,2,\gamma}$, the factor $\delta_{\gamma,3\gamma}$, . . . , the factor $\delta_{\gamma,(\text{an integral multiple of "}\gamma\text{"})}$, is a local maximum. More specifically, the template $TP_{\gamma=2}$ is designed to fit musical pieces in which a beat exists in every two frames, for example. In this example, the templates TP are used for calculating the likelihoods P of the BPM feature values XB. Instead of the templates TP, however, a probability distribution function (such as multinomial distribution, Dirichlet distribution, multidimensional normal distribution, and multidimensional Poisson distribution) may be used.

Figure 11:
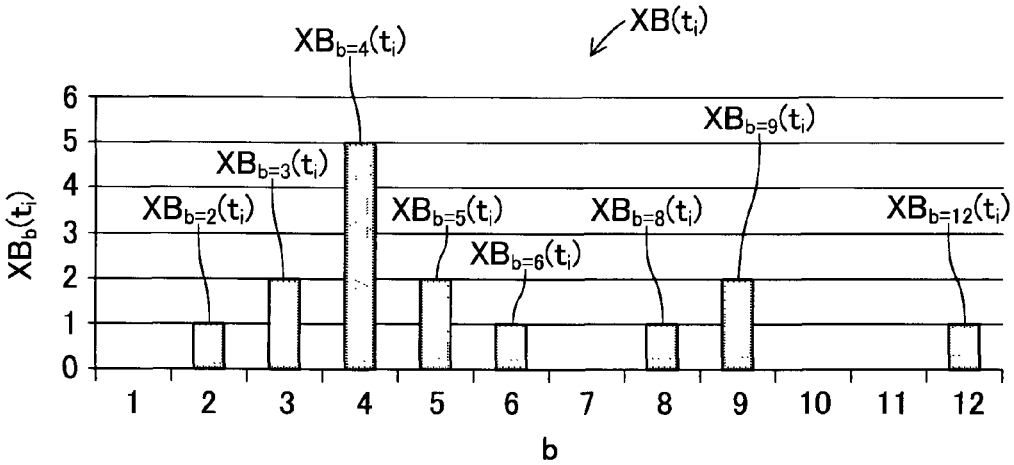
FIG. 11 is a graph indicative of calculated results of BPM feature values.
Figures 15, 16:
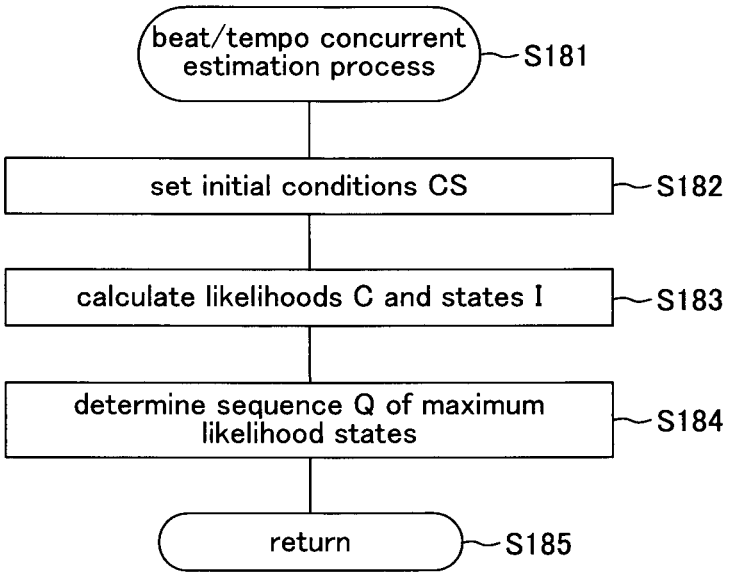
FIG. 15 is a chart indicative of calculated results of observation likelihood of BPM feature value.
FIG. 16 is a flowchart of a beat/tempo concurrent estimation program.

FIG. 15 exemplifies results of log calculation by calculating the likelihoods P $(XB(t_i)|Z_{b,n}(t_i))$ by use of the templates $TP_\gamma\{\gamma=1, 2, \ldots\}$ indicated in FIG. 14 in a case where the BPM feature values $XB(t_i)$ are values as indicated in FIG. 11. In this example, since the likelihood P $(XB(t_i)|Z_{b=4,n}(t_i))$ is the maximum, the BPM feature value $XB(t_i)$ best fits the template $TP_4$.

At step S174, the CPU 12*a* combines the log of the likelihood P $(XO(t_i)|Z_{b,n}(t_i))$ and the log of the likelihood P$(XB(t_i)|Z_{b,n}(t_i))$ and define the combined result as log observation likelihood $L_{b,n}(t_i)$. The same result can be similarly obtained by defining, as the log observation likelihood $L_{b,n}(t_i)$, a log of a result obtained by combining the likelihood P $(XO(t_i)|Z_{b,n}(t_i))$ and the likelihood P $(XB(t_i)|Z_{b,n}(t_i))$. At step S175, the CPU 12*a* terminates the log observation likelihood calculation process to proceed to step S18 of the sound signal analysis process (main routine).

At step S18, the CPU 12*a* reads out the beat/tempo concurrent estimation program indicated in FIG. 16 from the ROM 12*b*, and executes the program. The beat/tempo concurrent estimation program is a subroutine of the sound signal analysis program. The beat/tempo concurrent estimation program is a program for calculating a sequence Q of the maximum likelihood states by use of Viterbi algorithm. Hereafter, the program will be briefly explained. As a likelihood $C_{b,n}(t_i)$, first of all, the CPU 12*a* stores the likelihood of state $q_{b,n}$ in a case where a sequence of the likelihood is selected as if the state $q_{b,n}$ of frames $t_i$ is maximum when the onset feature values XO and the BPM feature values XB are observed from frame $t_0$ to frame $t_i$. As a state $I_{b,n}(t_i)$, furthermore, the CPU 12*a* also stores a state (state immediately before transition) of a frame immediately preceding the transition to the state $q_{b,n}$, respectively. More specifically, if a state after a transition is a state $q_{b=\beta e,n=\eta e}$, with a state before the transition being a state $q_{b=\beta s,n=\eta s}$, a state $I_{b=\beta e,n=\eta e}(t_i)$ is the state $q_{b=\beta s,n=\eta s}$. The CPU 12*a* calculates the likelihoods C and the states I until the CPU 12*a* reaches frame $t_{last}$) and selects the maximum likelihood sequence Q by use of the calculated results.

In a concrete example which will be described later, it is assumed for the sake of simplicity that the value of the beat period b of musical pieces which will be analyzed is "3", "4", or "5". As a concrete example, more specifically, procedures of the beat/tempo concurrent estimation process of a case where the log observation likelihoods $L_{b,n}(t_i)$ are calculated as exemplified in FIG. 17 will be explained. In this example, it is assumed that the observation likelihoods of states where the value of the beat period b is any value other than "3", "4" and "5" are sufficiently small, so that the observation likelihoods of the cases where the beat period b is any value other than "3", "4" and "5" are omitted in FIGS. 17 to 19. In this example, furthermore, the values of log transition probability T from a state where the value of the beat period b is "βs" with the value of the number n of frames "ηs" to a state where the value of the beat cycle b is "βe" with the value of the number n of frames "ηe" are set as follows: if "ηe=0", "βe=βs", and "ηe=βe−1", the value of log transition probability T is "−0.2". If "ηs=0", "βe=βs+1", and "ηe=βe−1", the value of log transition probability T is "−0.6". If "ηs=0", "βe=βs−1", and "ηe=βe−1", the value of log transition probability T is "−0.6". If "ηs>0", "βe=βs", and "ηe=ηs−1", the value of log transition probability T is "0". The value of log transition probability T of cases other than the above-described cases is "−∞". More specifically, at the transition from the state (ηs=0) where the value of the number n of frames is "0" to the next state, the value of the beat period b increases or decreases by "1". At this transition, furthermore, the value of the number n of frames is set at a value which is smaller by "1" than the post-transition beat period value b. At the transition from the state (ηs≠0) where the value of the number n of frames is not "0" to the next state, the value of the beat period b will not be changed, but the value of the number n of frames decreases by "1".

Hereafter, the beat/tempo concurrent estimation process will be explained concretely. At step S181, the CPU 12*a* starts the beat/tempo concurrent estimation process. At step S182, by use of the input operating elements 11, the user inputs initial conditions $CS_{b,n}$ of the likelihoods C corresponding to the respective states $q_{b,n}$ as indicated in FIG. 18. The initial conditions $CS_{b,n}$ may be stored in the ROM 12*b* so that the CPU 12*a* can read out the initial conditions $CS_{b,n}$ from the ROM 12*b*.

At step S183, the CPU 12*a* calculates the likelihoods $C_{b,n}(t)$ and the states $I_{b,n}(t_i)$. The likelihood $C_{b=\beta e,n=\eta e}(t_0)$ of the state $q_{b=\beta e,n=\eta e}$ where the value of the beat cycle b is "βe" at frame $t_0$ with the value of the number n of frames being "ηe" can be obtained by combining the initial condition $CS_{b=\beta e,n=\eta e}$ and the log observation likelihood $L_{b=\beta e,n=\eta e}(t_0)$.

Furthermore, at the transition from the state $q_{b=\beta s,n=\eta s}$ to the state $q_{b=\beta e,n=\eta e}$, the likelihoods $C_{b=\beta e,n=\eta e}(t_i)$ $\{i>0\}$ can be calculated as follows. If the number n of frames of the state $q_{b=\beta s,n=\eta s}$ is not "0" (that is, ηe≠0), the likelihood $C_{b=\beta e,n=\eta e}(t_i)$ is obtained by combining the likelihood $C_{b=\beta e,n=\eta e+1}(t_{i-1})$, the log observation likelihood $L_{b=\beta e,n=\eta e}(t_i)$, and the log transition probability T. In this embodiment, however, since the log transition probability T of a case where the number n of frames of a state which precedes a transition is not "0" is "0", the likelihood $C_{b=\beta e,n=\eta e}(t)$ is substantially obtained by combining the likelihood $C_{b=\beta e,n=\eta e+1}(t_{i-1})$ and the log observation likelihood $L_{b=\beta e,n=\eta e}(t_i)$ ($C_{b=\beta e,n=\eta e}(t_i)=C_{b=\beta e,n=\eta e+1}(t_{i-1})+L_{b=\beta e,n=\eta e}(t_i)$). In this case, furthermore, the state $I_{b=\beta e,n=\eta e}(t_i)$ is the state $q_{b=\beta e,\eta e+1}$. In an example where the likelihoods C are calculated as indicated in FIG. 18, for example, the value of the likelihood $C_{4,1}(t_2)$ is "2", while the value of the log observation likelihood $L_{4,0}(t_3)$ is "1". Therefore, the likelihood $C_{4,0}(t_3)$ is "3". As indicated in FIG. 19, furthermore, the state $I_{4,0}(t_3)$ is the state $q_{4,1}$.

Furthermore, the likelihood $C_{b=\beta e,n=\eta e}(t_i)$ of a case where the number n of frames of the state $q_{b=\beta s,n=\eta s}$ is "0" ($\eta s=0$) is calculated as follows. In this case, the value of the beat period b can increase or decrease with state transition. Therefore, the log transition probability T is combined with the likelihood $C_{\beta e-1,0}(t_0)$, the likelihood $C_{\beta e,0}(t_0)$ and the likelihood $C_{\beta e+1,0}(t_{i-1})$, respectively. Then, the maximum value of the combined results is further combined with the log observation likelihood $C_{b=\beta e,n=\eta e}(t_i)$ to define the combined result as the likelihood $C_{b=\beta e,n=\eta e}(t_i)$. Furthermore, the state $I_{b=\beta e,n=\eta e}(t_i)$ is a state q selected from among state $q_{\beta e-1,0}$, state $q_{\beta e,0}$, and state $q_{\beta e+1,0}$. More specifically, the log transition probability T is added to the likelihood $C_{\beta e-1,0}(t_{i-1})$, the likelihood $C_{\beta e,0}(t_{i-1})$ and the likelihood $C_{\beta e+1,0}(t_{i-1})$ of the state $C_{\beta e-1,0}$, state $q_{\beta e,0}$, and state $q_{\beta e+1,0}$, respectively, to select a state having the largest added value to define the selected state as the state $I_{b=\beta e,n=\eta e}(t_i)$. More strictly, the likelihoods $C_{b,n}(t_i)$ have to be normalized. Even without normalization, however, the results of estimation of beat positions and changes in tempo are mathematically the same.

For instance, the likelihood $C_{4,3}(t_4)$ is calculated as follows. Since in a case where a state preceding a transition is state $q_{3,0}$, the value of the likelihood $C_{3,0}(t_3)$ is "0.4" with the log transition probability T being "−0.6", a value obtained by combining the likelihood $C_{3,0}(t_3)$ and the log transition probability T is "−0.2". Furthermore, since in a case where a state preceding a transition is state $q_{4,0}$, the value of the likelihood $C_{4,0}(t_3)$ preceding the transition is "3" with the log transition probability T being "−0.2", a value obtained by combining the likelihood $C_{4,0}(t_3)$ and the log transition probability T is "2.8". Furthermore, since in a case where a state preceding a transition is state $q_{5,0}$, the value of the likelihood $C_{5,0}(t_3)$ preceding the transition is "1" with the log transition probability T being "−0.6", a value obtained by combining the likelihood $C_{5,0}(t_3)$ and the log transition probability T is "0.4". Therefore, the value obtained by combining the likelihood $C_{4,0}(t_3)$ and the log transition probability T is the largest. Furthermore, the value of the log observation likelihood $L_{4,3}(t_4)$ is "0". Therefore, the value of the likelihood $C_{4,3}(t_4)$ is "2.8" (=2.8+0). Therefore, the value of the likelihood $C_{4,3}(t_4)$ is "2.8" (=2.8+0), so that the state $I_{4,3}(t_4)$ is the state $q_{4,0}$.

When completing the calculation of likelihoods $C_{b,n}(t_i)$ and the states $I_{b,n}(t_i)$ of all the states $q_{b,n}$ for all the frames $t_i$, the CPU 12*a* proceeds to step S184 to determine the sequence Q of the maximum likelihood states ($=\{q_{max}(t_0), q_{max}(t_1), q_{max}(t_{last})\}$) as follows. First, the CPU 12*a* defines a state $q_{b,n}$ which is in frame $t_{last}$ and has the maximum likelihood $C_{b,n}(t_{last})$ as a state $q_{max}(t_{last})$, The value of the beat period b of the state $q_{max}(t_{last})$, is denoted as "βm", while the value of the number n of frames is denoted as "ηm". More specifically, the state $I_{\beta m,\eta m}$ is a state $q_{max}(t_{last-1})$ of the frame $t_{last-1}$ which immediately precedes the frame $t_{last.}$ The state $q_{max}(t_{last-2})$, the state $q_{max}(t_{last-3})$, . . . of frame $(t_{last-2})$, frame $(t_{last-3})$, . . . are also determined similarly to the state $q_{max}(t_{last-1})$. More specifically, the state $I_{\beta m,\eta m}(t_{i+1})$ where the value of the beat period b of a state $q_{max}(t_{i+1})$ of frame $t_{i+1}$ is denoted as "βm" with the value of the number n of frames being denoted as "ηm" is the state $q_{max}(t_i)$ of the frame $t_i$ which immediately precedes the frame $t_{i+1}$. As described above, the CPU 12*a* sequentially determines the states $q_{max}$ from frame $t_{last-1}$ toward frame $t_0$ to determine the sequence Q of the maximum likelihood states.

In the example shown in FIG. 18 and FIG. 19, for example, in the frame $t_{last=9}$, the likelihood $C_{4,2}(t_{last=9})$ of the state $q_{4,2}$ is the maximum. Therefore, the state $q_{max}(t_{last=9})$ is the state $q_{4,2}$. According to FIG. 19, since the state $I_{4,2}(t_9)$ is the state $q_{4,3}$, the state $q_{max}(t_8)$ is the state $q_{4,3}$. Furthermore, since the state $I_{4,3}(t_0)$ is the state $q_{4,0}$, the state $q_{max}(t_7)$ is the state $q_{4,0}$. States $q_{max}(t_6)$ to $q_{max}(t_0)$ are also determined similarly to the state $q_{max}(t_8)$ and the state $q_{max}(t_7)$. As described above, the sequence Q of the maximum likelihood states indicated by arrows in FIG. 18 is determined. In this example, the value of the beat period b is estimated as "4" at any frame $t_i$. In the sequence Q, furthermore, it is estimated that a beat exists in frames $t_1$, $t_5$, and $t_8$ corresponding to states $q_{max}(t_1)$, $q_{max}(t_5)$ and $q_{max}(t_8)$ where the value of the number n of frames is "0".

At step S185, the CPU 12*a* terminates the beat/tempo concurrent estimation process to proceed to step S19 of the sound signal analysis process (main routine).

At step S19, the CPU 12*a* calculates "BPM-ness", "probability based on observation", "beatness", "probability of existence of beat", and "probability of absence of beat" for each frame t; (see expressions indicated in FIG. 20). The "BPM-ness" represents a probability that a tempo value in frame $t_i$ is a value corresponding to the beat period b. The "BPM-ness" is obtained by normalizing the likelihood $C_{b,n}(t_i)$ and marginalizing the number n of frames. More specifically, the "BPM-ness" of a case where the value of the beat period b is "β" is a ratio of the sum of the likelihoods C of the states where the value of the beat period b is "β" to the sum of the likelihoods C of all states in frame $t_i$. The "probability based on observation" represents a probability calculated on the basis of observation values (i.e., onset feature values XO) where a beat exists in frame $t_i$. More specifically, the "probability based on observation" is a ratio of onset feature value $XO(t_i)$ to a certain reference value $XO_{base}$. The "beatness" is a ratio of the likelihood $P(XO(t_i)|Z_{b,0}(t_i))$ to a value obtained by combining the likelihoods $P(XO(t_i)|Z_{b,n}(t_i))$ of onset feature values XO (ti) of all values of the number n of frames. The "probability of existence of beat" and "probability of absence of beat" are obtained by marginalizing the likelihood $C_{b,n}(t_i)$ for the beat period b. More specifically, the "probability of existence of beat" is a ratio of a sum of the likelihoods C of states where the value of the number n of frames is "0" to a sum of the likelihoods C of all states in frame $t_i$. The "probability of absence of beat" is a ratio of a sum of the likelihoods C of states where the value of the number n of frames is not "0" to a sum of the likelihoods C of all states in frame $t_i$.

Figure 20:
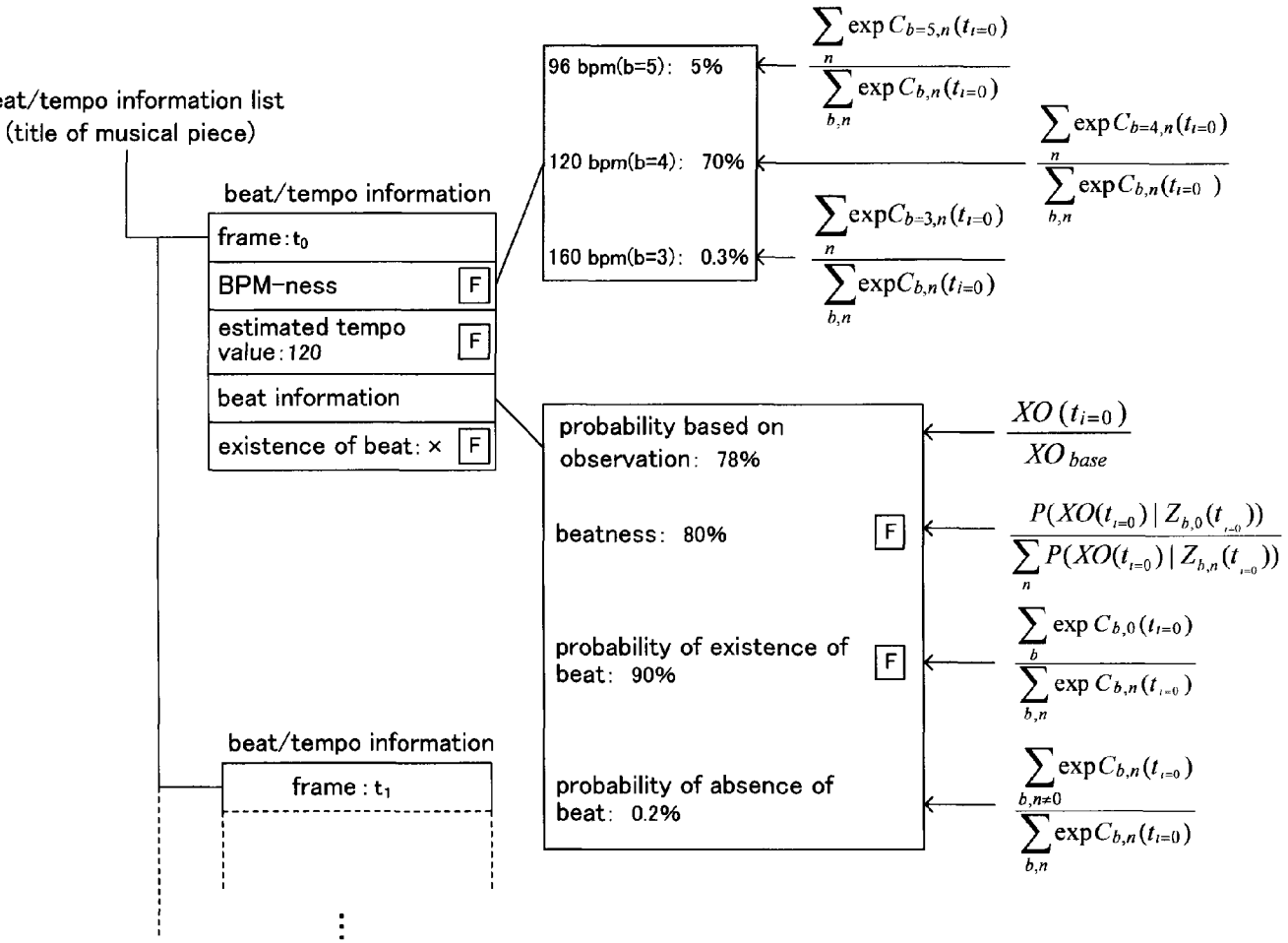
FIG. 20 is a schematic diagram schematically indicating a beat/tempo information list.
Figure 21:
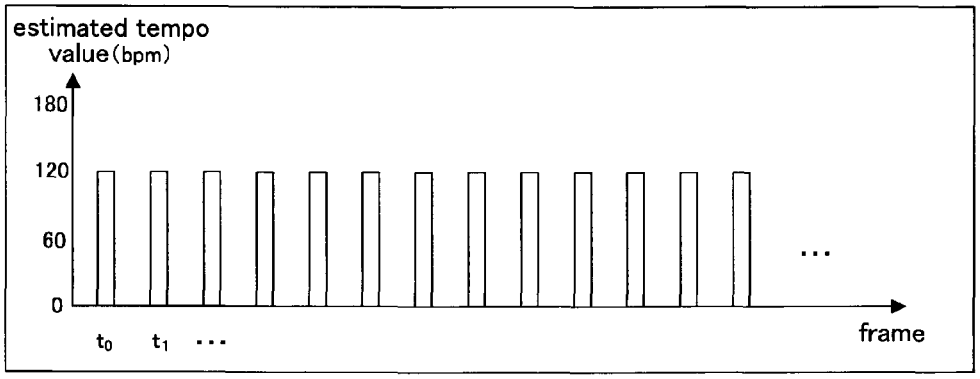
FIG. 21 is a graph indicative of an example of changes in tempo.
Figure 22:
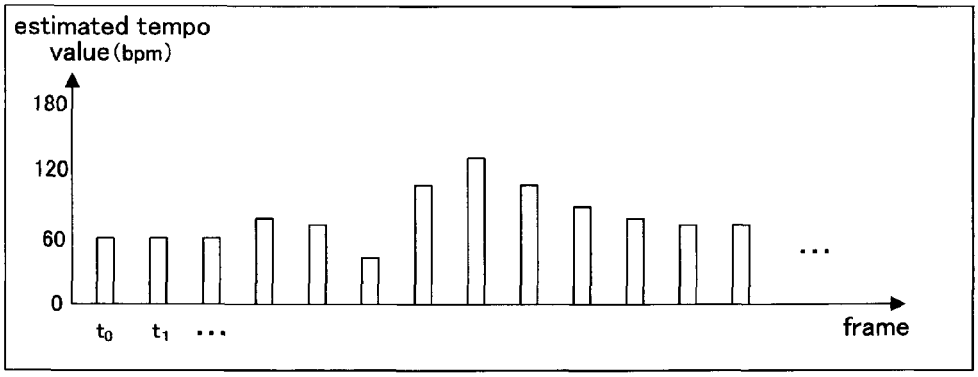
FIG. 22 is a graph indicative of a different example of changes in tempo.
Figure 23:
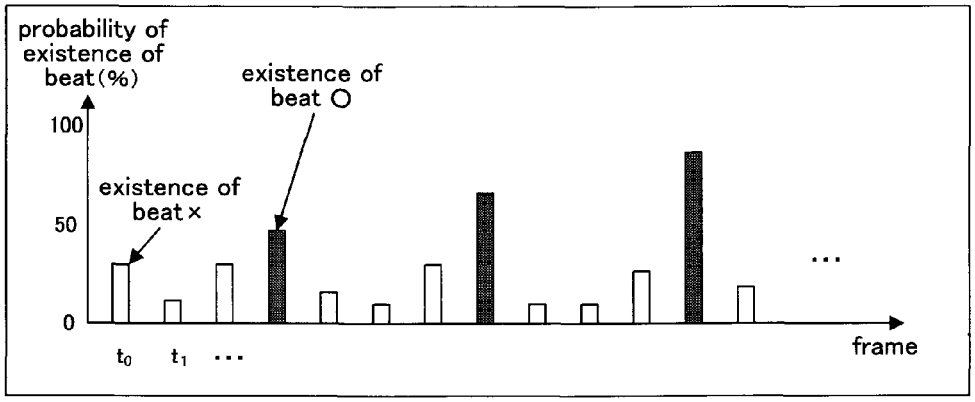
FIG. 23 is a graph indicative of beat positions.

By use of the "BPM-ness", "probability based on observation", "beatness", "probability of existence of beat", and "probability of absence of beat", the CPU 12*a* displays a beat/tempo information list indicated in FIG. 20 on the display unit 13. On an "estimated tempo value (BPM)" field of the list, a tempo value (BPM) corresponding to the beat period b having the highest probability among those included in the above-calculated "BPM-ness" is displayed. On an "existence of beat" field of the frame which is included in the above-determined states $q_{max}(t_i)$ and whose value of the number n of frames is "0", "○" is displayed. On the "existence of beat" field of the other frames, "x" is displayed. By use of the estimated tempo value (BPM), furthermore, the CPU 12*a* displays a graph indicative of changes in tempo as shown in FIG. 21 on the display unit 13. The example shown in FIG. 21 represents changes in tempo as a bar graph. In the example explained with reference to FIG. 18 and FIG. 19, since the tempo value is constant, bars indicative of tempo of respective frames have a uniform height as indicated in FIG. 21. However, a musical piece whose tempo frequently changes has bars of different heights depending on tempo value as indicated in FIG. 22. Therefore, the user can visually recognize changes in tempo. By use of the above-calculated "probability of existence of beat", furthermore, the CPU 12*a* displays a graph indicative of beat positions as indicated in FIG. 23 on the display unit 13.

Furthermore, in a case where existing data has been found by the search for existing data at step S13 of the sound signal analysis process, the CPU 12*a* displays the beat/tempo information list, the graph indicative of changes in tempo, and the graph indicative of beat positions on the display unit 13 at step S19 by use of various kinds of data on the previous analysis results read into the RAM 12*c* at step S15.

At step S20, the CPU 12*a* displays a message asking whether the user desires to terminate the sound signal analysis process or not on the display unit 13, and waits for user's instructions. Using the input operating elements 11, the user instructs either to terminate the sound signal analysis process or to execute a later-described beat/tempo information correction process. For instance, the user clicks on an icon with a mouse. If the user has instructed to terminate the sound signal analysis process, the CPU 12*a* determines "Yes" to proceed to step S21 to store various kinds of data on results of analysis of the likelihoods C, the states I, and the beat/tempo information list in the storage device 14 so that the various kinds of data are associated with the title of the musical piece to proceed to step S22 to terminate the sound signal analysis process.

If the user has instructed to continue the sound signal analysis process at step S20, the CPU 12*a* determines "No" to proceed to step S23 to execute the tempo information correction process. First, the CPU 12*a* waits until the user completes input of correction information. Using the input operating elements 11, the user inputs a corrected value of the "BPM-ness", "probability of existence of beat" or the like. For instance, the user selects a frame that the user desires to correct with the mouse, and inputs a corrected value with the numeric keypad. Then, a display mode (color, for example) of "F" located on the right of the corrected item is changed in order to explicitly indicate the correction of the value. The user can correct respective values of a plurality of items. On completion of input of corrected values, the user informs of the completion of input of correction information by use of the input operating elements 11. Using the mouse, for example, the user clicks on an icon indicates completion of correction. The CPU 12*a* updates either of or both of the likelihood P (XO $(t_i)|Z_{b,n}(t_i)$) and the likelihood P (XB $(t)|Z_{b,n}(t_i)$) in accordance with the corrected value. For instance, in a case where the user has corrected such that the "probability of existence of beat" in frame $t_i$ is raised with the value of the number n of frames on the corrected value being "ηe", the CPU 12*a* sets the likelihood P (XB $(t_i)|Z_{b,n=\eta e}(t_i)$) at a value which is sufficiently small. At frame $t_i$, as a result, the probability that the value of the number n of frames is "ηe" is relatively the highest. For instance, furthermore, in a case where the user has corrected the "BPM-ness" of frame $t_i$ such that the probability that the value of the beat period b is "βe" is raised, the CPU 12*a* sets the likelihoods P (XB $(t)|Z_{b\neq\beta e,n}(t_i)$) of states where the value of the beat period b is not "βe" at a value which is sufficiently small. At frame $t_i$, as a result, the probability that the value of the beat period b is "βe" is relatively the highest. Then, the CPU 12*a* terminates the beat/tempo information correction process to proceed to step S18 to execute the beat/tempo concurrent estimation process again by use of the corrected log observation likelihoods L.

The sound signal analysis apparatus 10 configured as above can select a probability model of the most likely sequence of the log observation likelihoods L calculated by use of the onset feature values XO relating to beat position and the BPM feature values XB relating to tempo to concurrently (jointly) estimate beat positions and changes in tempo in a musical piece. Unlike the above-described related art, therefore, the sound signal analysis apparatus 10 will not present a problem that a low accuracy of estimation of either beat positions or tempo causes low accuracy of estimation of the other. As a result, the sound signal analysis apparatus 10 can enhance estimation accuracy of beat positions and changes in tempo in a musical piece, compared with the related art.

In this embodiment, furthermore, the transition probability (log transition probability) between states is set such that transition is allowed only from a state where the value of the number n of frames is "0" to a state of the same value of the beat period b or a state where the value of the beat period b is different by "1". Therefore, the sound signal analysis apparatus 10 can prevent erroneous estimation which brings about abrupt changes in tempo between frames. Consequently, the sound signal analysis apparatus 10 can obtain estimation results which bring about natural beat positions and changes in tempo as a musical piece. For musical pieces in which the tempo abruptly changes, the sound signal analysis apparatus 10 may set transition probability (log transition probability) between states such that a transition from a state where the value of the number n of frames between the next beat is "0" to a state of a largely different value of the beat cycle b is also allowed.

Since the sound signal analysis apparatus 10 uses Viterbi algorithm for the beat/tempo concurrent estimation process, the sound signal analysis apparatus 10 can reduce the amount of calculation, compared to cases where a different algorithm ("sampling method", "forward-backward algorithm" or the like, for example) is used.

In accordance with user's input correction information, furthermore, the sound signal analysis apparatus 10 corrects log observation likelihoods L, and re-estimates beat positions and changes in tempo in a musical piece in accordance with the corrected log observation likelihoods L. Therefore, the sound signal analysis apparatus 10 re-calculates (re-selects) states $q_{max}$ of the maximum likelihoods of one or more frames situated in front of and behind the corrected frame. Consequently, the sound signal analysis apparatus 10 can obtain estimation results which bring about smooth changes in beat intervals and tempo from the corrected frame to the one or more frames situated in front of and behind the corrected frame.

The information about changes in beat position and tempo in a musical piece estimated as above is used for search for musical piece data and search for accompaniment data representative of accompaniment, for example. In addition, the information is also used for automatic generation of accompaniment part and for automatic addition of harmony for an analyzed musical piece.

Furthermore, the present invention is not limited to the above-described embodiment, but can be modified variously without departing from object of the invention.

For example, the above-described embodiment selects a probability mode of the most likely observation likelihood sequence indicative of probability of concurrent observation of the onset feature values XO and the BPM feature values XB as observation values. However, criteria for selection of probability model are not limited to those of the embodiment. For instance, a probability model of maximum a posteriori distribution may be selected.

Furthermore, the above-described embodiment is designed, for the sake of simplicity, such that the length of each frame is 125 ms. However, each frame may have a shorter length (e.g., 5 ms). The reduced frame length can contribute improvement in resolution relating to estimation of beat position and tempo. For example, the enhanced resolution enables tempo estimation in increments of 1 BPM. Furthermore, although the above-described embodiment is designed to have frames of the same length, the frames may have different lengths. In such a case as well, the onset feature values XO can be calculated similarly to the embodiment. For calculation of BPM feature values XB, in this case, it is preferable to change the amount of delay of the comb filters in accordance with the frame length. For calculation of the likelihoods C, furthermore, the greatest common divisor F of respective lengths of frames (that is, the greatest common divisor of the number of samples which form frames) is figured out. Then, it is preferable to define a probability of transition from a state $q_{b,n\ (n\neq 0)}$ to a state $q_{b,n-L\ (\tau)}$ as 100% if the length of a frame $t_i$ (=τ) is represented by L (τ)×F.

In the above-described embodiment, furthermore, a whole musical piece is subjected to analysis. However, only a part of a musical piece (e.g., a few bars) may be subjected to analysis. In this case, the embodiment may be modified to allow a user to select a portion of input musical piece data to define as a portion to analyze. In addition, only a single part (e.g., rhythm section) of a musical piece may be subjected to analysis.

For tempo estimation, furthermore, the above-described embodiment may be modified such that a user can specify a tempo range which is given a high priority in estimation. At step S12 of the sound signal analysis process, more specifically, the sound signal analysis apparatus 10 may display terms indicative of tempo such as "Presto" and "Moderato" so that the user can choose a tempo range which is to be given a high priority in estimation. In a case where the user chooses "Presto", for instance, the sound signal analysis apparatus 10 is to set the log observation likelihoods L for those other than a range of BPM=160 to 190 at a sufficiently small value. As a result, a tempo of the range of BPM=160 to 190 can be preferentially estimated. Consequently, the sound signal analysis apparatus 10 can enhance accuracy in tempo estimation in a case where the user knows an approximate tempo of a musical piece subjected to analysis.

In the beat/tempo information correction process (step S23), the user is prompted to input correction by use of the input operating elements 11. Instead of or in addition to the input operating elements 11, however, sound signal analysis apparatus 10 may allow the user to input corrections by use of operating elements of an electronic keyboard musical instrument, an electronic percussion instrument or the like connected via the external interface circuit 15. In response to user's depressions of keys of the electronic keyboard instrument, for example, the CPU 12*a* calculates tempo in accordance with the timing of the user's key-depressions to use the calculated tempo as a corrected value of the "BPM-ness".

In the embodiment, furthermore, the user can input corrected values on beat positions and tempo as many times as the user desires. However, the embodiment may be modified to disable user's input of a corrected value on beat positions and tempo if the mean value of "probability of existence of beat" has reached a reference value (e.g., 80%).

As for the beat/tempo information correction process (step S23), furthermore, the embodiment may be modified such that, in addition to the correction of beat/tempo information of a user's specified frame to have a user's input value, beat/tempo information of neighboring frames of the user's specified frame is also automatically corrected in accordance with the user's input value. For example, in a case where a few successive frames have the same estimated tempo value, with the value of one of the frames being corrected by the user, the sound signal analysis apparatus 10 may automatically correct the respective tempo values of the frames to have the user's corrected value.

In the above-described embodiment, furthermore, at step S23, in response to user's indication of completion of input of a corrected value by use of the input operating elements 11, the concurrent estimation of beat position and tempo is carried out again. However, the embodiment may be modified such that the estimation of beat position and tempo is carried out again when a certain period of time (e.g., 10 seconds) has passed without any additional correction of any other values after user's input of at least one corrected value.

Furthermore, the display mode of the beat/tempo information list (FIG. 20) is not limited to that of the embodiment. For instance, although the "BPM-ness", "beatness" and the like are indicated by probability (%) in this embodiment, the "BPM-ness", "beatness" and the like may be represented by symbols, character strings or the like. In the embodiment, furthermore, "○" is displayed on the "existence of beat" field of frame $t_i$ which is included in the determined states $q_{max}$ ($t_i$) and whose number n of frames is "0", while "x" is displayed on the "existence of beat" field of the other frames. Instead of the display mode of this embodiment, however, the embodiment may be modified such that "○" is displayed on the "existence of beat" field if the "probability of existence of beat position" is a reference value (e.g., 80%) or more, while "x" is displayed on the "existence of beat" field if the "probability of existence of beat position" is less than the reference value. In this modification, furthermore, a plurality of reference values may be provided. For instance, the first reference value (=80%) and the second reference value (=60%) may be provided so that "○" can be displayed on the "existence of beat" field if the "probability of existence of beat position" is the first reference value or more," "Δ" can be displayed on the "existence of beat" field if the "probability of existence of beat position" is the second reference value or more and less than the first reference value, and "x" is displayed on the "existence of beat" field if the "probability of existence of beat position" is less than the second reference value. Furthermore, the embodiment may be modified such that a term indicative of tempo such as "Presto" and "Moderato" is displayed on the field of estimated tempo value.

What is claimed is:

1. A sound signal analysis apparatus comprising:

a non-transitory memory device;

a processor;

a sound signal input portion for inputting a sound signal indicative of a musical piece;

a feature value calculation portion for calculating a first feature value indicative of a feature relating to existence of a beat in one of sections of the musical piece and a second feature value indicative of a feature relating to tempo in one of the sections of the musical piece; and an estimation portion for concurrently estimating a beat position and a change in tempo in the musical piece by selecting, from among a plurality of probability models described as sequences of states classified according to a combination of a physical quantity relating to existence of a beat in one of the sections of the musical piece and a physical quantity relating to tempo in one of the sections of the musical piece, a probability model whose sequence of observation likelihoods each indicative of a probability of concurrent observation of the first feature value and the second feature value in corresponding one of the sections of the musical piece satisfies a certain criterion, wherein the sound signal input portion, the feature value calculation portion, and the estimation portion are implemented at least in part by the processor executing at least one program recorded on the non-transitory memory device.

2. The sound signal analysis apparatus according to claim 1, wherein the estimation portion concurrently estimates a beat position and a change in tempo in the musical piece by selecting a probability model of the most likely sequence of observation likelihoods from among the plurality of probability models.

3. The sound signal analysis apparatus according to claim 1, wherein the estimation portion has first probability output portion for outputting, as a probability of observation of the first feature value, a probability calculated by assigning the first feature value as a probability variable of a probability distribution function defined according to the physical quantity relating to existence of beat.

4. The sound signal analysis apparatus according to claim 3, wherein as a probability of observation of the first feature value, the first probability output portion outputs a probability calculated by assigning the first feature value as a probability variable of any one of normal distribution, gamma distribution and Poisson distribution defined according to the physical quantity relating to existence of beat.

5. The sound signal analysis apparatus according to claim 1, wherein the estimation portion has second probability output portion for outputting, as a probability of observation of the second feature value, goodness of fit of the second feature value to a plurality of templates provided according to the physical quantity relating to tempo.

6. The sound signal analysis apparatus according to claim 1, wherein the estimation portion has second probability output portion for outputting, as a probability of observation of the second feature value, a probability calculated by assigning the second feature value as a probability variable of probability distribution function defined according to the physical quantity relating to tempo.

7. The sound signal analysis apparatus according to claim 6, wherein as a probability of observation of the second feature value, the second probability output portion outputs a probability calculated by assigning the first feature value as a probability variable of any one of multinomial distribution, Dirichlet distribution, multidimensional normal distribution, and multidimensional Poisson distribution defined according to the physical quantity relating to existence of beat.

8. The sound signal analysis apparatus according to claim 1, wherein the sections of the musical piece correspond to frames, respectively, formed by dividing the input sound signal at certain time intervals; and the feature value calculation portion has:

a first feature value calculation portion for calculating amplitude spectrum for each of the frames, applying a plurality of window functions each having a different frequency band to the amplitude spectrum to generate amplitude spectrum for each frequency band, and outputting, as the first feature value, a value calculated on the basis of a change in amplitude spectrum provided for the each frequency band between the frames; and a second feature value calculation portion having a filter that outputs a value in response to each input of a value corresponding to a frame, that has keeping portion for keeping the output value for a certain period of time, and that combines the input value and the value kept for the certain period of time at a certain ratio, and output the combined value, the second feature value calculation portion outputting, as a sequence of the second feature values, a data sequence obtained by inputting, to the filter, a data sequence obtained by reversing a time sequence of a data sequence obtained by inputting a sequence of the first feature values to the filter.

9. The sound signal analysis apparatus according to claim 1, further comprising:

a correction information input portion for inputting correction information indicative of corrected content of one of or both of a beat position and a change in tempo in the musical piece;

a observation likelihood correction portion for correcting the observation likelihoods in accordance with the input correction information; and a re-estimation portion for re-estimating a beat position and a change in tempo in the musical piece concurrently by selecting, by use of the estimation portion, a probability model whose sequence of the corrected observation likelihoods satisfies the certain criterion from among the plurality of probability models, wherein the correction information input portion, the observation likelihood correction portion, and the re-estimation portion are implemented at least in part by the processor executing at least one program recorded on the non-transitory memory device.

10. A sound signal analysis method comprising:

inputting a sound signal indicative of a musical piece;

calculating a first feature value indicative of a feature relating to existence of a beat in one of sections of the musical piece and a second feature value indicative of a feature relating to tempo in one of the sections of the musical piece; and concurrently estimating a beat position and a change in tempo in the musical piece by selecting, from among a plurality of probability models described as sequences of states classified according to a combination of a physical quantity relating to existence of a beat in one of the sections of the musical piece and a physical quantity relating to tempo in one of the sections of the musical piece, a probability model whose sequence of observation likelihoods each indicative of a probability of concurrent observation of the first feature value and the second feature value in corresponding one of the sections of the musical piece satisfies a certain criterion.

11. A non-transitory computer-readable storage medium having stored thereon a sound signal analysis program configured to cause a computer to execute a sound signal analysis method comprising:

inputting a sound signal indicative of a musical piece;

calculating a first feature value indicative of a feature relating to existence of a beat in one of sections of the musical piece and a second feature value indicative of a feature relating to tempo in one of the sections of the musical piece; and concurrently estimating a beat position and a change in tempo in the musical piece by selecting, from among a plurality of probability models described as sequences of states classified according to a combination of a physical quantity relating to existence of a beat in one of the sections of the musical piece and a physical quantity relating to tempo in one of the sections of the musical piece, a probability model whose sequence of observation likelihoods each indicative of a probability of concurrent observation of the first feature value and the second feature value in corresponding one of the sections of the musical piece satisfies a certain criterion.

* * * * *